US011766130B2

(12) United States Patent
Atkinson

(10) Patent No.: US 11,766,130 B2
(45) Date of Patent: Sep. 26, 2023

(54) LIFT SYSTEM INCLUDING A LOCK ASSEMBLY AND RELEASE DEVICE

(71) Applicant: ATKINSON ERGONOMIC SOLUTIONS, INC., Naperville, IL (US)

(72) Inventor: Ronald Neil Atkinson, Naperville, IL (US)

(73) Assignee: Atkinson Ergonomic Solutions, Inc., Naperville, IL (US)

( * ) Notice: Subject to any disclaimer, the term of this patent is extended or adjusted under 35 U.S.C. 154(b) by 0 days.

(21) Appl. No.: 18/014,463

(22) PCT Filed: Aug. 5, 2021

(86) PCT No.: PCT/US2021/044639

§ 371 (c)(1),
(2) Date: Jan. 4, 2023

(87) PCT Pub. No.: WO2022/031906

PCT Pub. Date: Feb. 10, 2022

(65) Prior Publication Data

US 2023/0190005 A1 Jun. 22, 2023

Related U.S. Application Data

(60) Provisional application No. 63/062,553, filed on Aug. 7, 2020.

(51) Int. Cl.
*A47C 19/04* (2006.01)

(52) U.S. Cl.
CPC ..... *A47C 19/045* (2013.01)

(58) Field of Classification Search
CPC ..... A47C 19/045; A47C 31/00; A47C 17/86; A47C 20/041; A61G 7/012; A61G 7/018;
(Continued)

(56) References Cited

U.S. PATENT DOCUMENTS 1,682,577 A * 8/1928 Littlefield ..... A47C 19/045 5/8
2,139,923 A 12/1938 Woller
(Continued)

FOREIGN PATENT DOCUMENTS

EP 2 627 221 A1 8/2013
EP 3 222 170 A1 9/2017
(Continued)

OTHER PUBLICATIONS

International Search Report and Written Opinion for PCT Application No. PCT/US2021/044639, dated Nov. 9, 2021, 11 pages.

*Primary Examiner* — David R Hare
*Assistant Examiner* — Luke Hall
(74) *Attorney, Agent, or Firm* — Foley & Lardner LLP

(57) ABSTRACT

A lift system comprises a plurality of bottom components, a plurality of top components structured to support a structure thereon, and a lifting assembly coupled to each of the plurality of bottom components and the plurality of top components. The lifting assembly comprises a plurality of lifting members configured to move the lifting assembly between a lowered configuration and a raised configuration, and a locking member coupled to a corresponding lifting member and configured to move between a locked position and an unlocked position in the raised and lowered configuration of the lifting assembly. A lock assembly is coupled to the lifting assembly and includes a lock/unlock member and a linking component coupling the lock/unlock member to the locking member. A release device is selectively engaged with the lock/unlock member by a user to activate the lock assembly for unlocking the locking member.

20 Claims, 15 Drawing Sheets

(58) Field of Classification Search
CPC .... A61G 2203/42; A61G 13/06; A47B 21/02; A47B 2200/0041; A47B 9/16; A47B 9/00
USPC ..... 5/11
See application file for complete search history.

(56) References Cited

U.S. PATENT DOCUMENTS 2,481,965 A * 9/1949 Woller ..... A47D 7/03 5/93.1
2,592,166 A * 4/1952 Mclean ..... A61G 7/012 5/11
3,329,975 A 7/1967 Hooker
3,341,868 A 9/1967 Ingildsen
3,516,097 A * 6/1970 Angus ..... A47C 19/045 5/412
3,789,437 A 2/1974 Garte
3,887,950 A * 6/1975 Wachsman ..... A47C 19/045 5/11
4,194,452 A 3/1980 Crowther et al.
4,494,259 A 1/1985 Miller et al.
4,785,487 A * 11/1988 Toran ..... A47C 20/041 5/616
4,807,558 A * 2/1989 Swersey ..... G01G 19/445 177/145
5,020,173 A 6/1991 Dreyer, Jr.
5,549,052 A 8/1996 Hoffman
5,987,673 A * 11/1999 Smith ..... A61G 1/0562 280/655
5,990,423 A 11/1999 Ashpes et al.
6,405,393 B2 6/2002 Megown
6,494,538 B1 12/2002 Alvestad
6,991,199 B2 * 1/2006 Carpentier ..... A47B 9/02 312/246
7,150,056 B2 * 12/2006 Lemire ..... A61G 7/012 5/11
7,743,440 B2 * 6/2010 Burnett ..... A47C 17/86 5/200.1
7,757,313 B2 7/2010 Koorey
7,941,879 B2 5/2011 Burnett
8,739,329 B2 6/2014 Koorey
8,808,151 B1 * 8/2014 Whaley ..... A63B 21/078 482/129
9,049,923 B1 * 6/2015 Delagey ..... A47B 9/18
9,265,351 B2 * 2/2016 Koorey ..... A47C 19/04
9,615,655 B1 * 4/2017 Huang ..... A47B 21/02
9,743,776 B2 8/2017 Ray
10,918,216 B2 2/2021 Atkinson et al.
2004/0183276 A1 9/2004 Silva
2005/0172405 A1 8/2005 Menkedick et al.
2005/0251915 A1 * 11/2005 Elizondo ..... A47C 19/045 5/616
2005/0251916 A1 * 11/2005 Elizondo ..... A47C 19/045 5/611
2006/0026767 A1 2/2006 Chambers et al.
2007/0067912 A1 3/2007 Lemire
2007/0283494 A1 * 12/2007 Vasey ..... A47C 19/045 5/659
2008/0289112 A1 * 11/2008 Koorey ..... A47C 19/045 5/658
2012/0084921 A1 * 4/2012 Serhan ..... A61G 7/018 5/610
2013/0014675 A1 * 1/2013 Burkhalter ..... A47B 7/02 108/147.22
2013/0139736 A1 * 6/2013 Flaherty ..... A47B 21/02 108/162
2013/0291309 A1 * 11/2013 Koorey ..... A47C 19/045 5/658
2014/0182058 A1 * 7/2014 Chandler ..... A47C 19/045 5/11
2014/0259413 A1 * 9/2014 Johnson ..... A61G 7/08 5/613
2016/0120327 A1 * 5/2016 Shimada ..... A47C 19/045 5/11
2016/0136023 A1 * 5/2016 Johnson ..... A61G 7/012 5/11
2016/0331146 A1 * 11/2016 Ray ..... A47C 19/045
2017/0251817 A1 * 9/2017 Atkinson, Jr. ..... A47C 19/025
2017/0259725 A1 9/2017 Johnson et al.

FOREIGN PATENT DOCUMENTS

FR 2602655 2/1988
FR 3049179 9/2017

* cited by examiner

LIFT SYSTEM INCLUDING A LOCK ASSEMBLY AND RELEASE DEVICE

CROSS-REFERENCE TO RELATED PATENT APPLICATIONS

This application is the U.S. national stage of PCT Application No. PCT/US2021/044639, filed Aug. 5, 2021, which claims priority to and the benefit of U.S. Provisional Application No. 63/062,553 filed Aug. 7, 2020, which is incorporated herein by reference in its entirety.

TECHNICAL FIELD

The present disclosure relates generally to lifting assemblies for raising or lifting a bed off a floor.

BACKGROUND

Most beds include a bed frame on which a mattress and optionally, a box spring is disposed. The bed may also include bed sheets, pillows, comforters, etc. disposed on the mattress. The mattress and the box spring generally have a relatively significant weight. However, there are many situations in which the mattress and/or box spring may have to be lifted off the floor. For example, a person changing a bed sheet of the mattress often has to bend over to change sheets or otherwise make the bed. Bending over frequently and/or for extended periods of time may pose a number of safety and health issues. For example, the bending over may cause strain on the back and hands of the person making the bed (e.g., changing the sheets of the mattress). For example, in hotels and resorts, hospitality personnel or custodians may have to change numerous bed sheets on any given day. The repetitive bending over to change the bed sheets may cause severe injuries over time to the back, legs and/or hands of the persons changing the bed sheets.

SUMMARY

Embodiments described herein relate generally to systems and methods for raising or lifting a bed off or upwards from a surface and in particular, to a lift system that includes a lifting assembly that is configured to be disposed beneath a bed for selectively moving the bed between a lowered configuration and a raised configuration (and, in some embodiments, an intermediate configuration) such that the lifting assembly may be locked in each such configuration. The system also includes a lock assembly that is configured to selectively unlock the lifting assembly when a release device engages the lock assembly so as to allow the lifting assembly, and thereby a bed disposed thereon, to be moved between the lowered configuration and the raised configuration (and in some embodiments, the intermediate configuration).

In a set of embodiments, a lift system comprises a plurality of bottom components positionable on a surface, and a plurality of top components structured to support a structure. A lifting assembly is coupled to each of the plurality of bottom components and the plurality of top components. The lifting assembly comprises a plurality of lifting members, each of the plurality of lifting members having a lifting member first end coupled to at least one bottom component of the plurality of bottom components, and a lifting member second end opposite the lifting member first end coupled to at least one component of the plurality of top components. A locking member is configured to move between a locked position to lock the lifting assembly in each of a raised configuration and a lowered configuration of the lifting assembly, and an unlocked position to allow the lifting assembly to be moved between the raised configuration and the lowered configuration. A lock assembly is coupled to the lifting assembly. The lock assembly comprises a lock/unlock member, and at least one linking component coupling the lock/unlock member to the locking member. A release device is selectively engageable with the lock/unlock member so as to cause the lock/unlock member to move, the movement of the lock/unlock member pulling the linking component and causing the locking member to move into the unlocked position so as to allow the user to move the lifting assembly between the lowered configuration and the raised configuration.

In another set of embodiments, a lift system, comprises a plurality of bottom components positionable on a surface, and a plurality of top components structured to support a structure. A lifting assembly is coupled to each of the plurality of bottom components and the plurality of top components. The lifting assembly comprises a plurality of lifting members. Each of the plurality of lifting members has a lifting member first end coupled to at least one bottom component of the plurality of bottom components, and a lifting member second end opposite the lifting member first end coupled to at least one component of the plurality of top components. A release device is selectively engageable with the lifting assembly for moving the lifting assembly between a raised configuration and a lowered configuration.

In another set of embodiments, a lift system comprises a plurality of bottom components positionable on a surface, and a plurality of top components structured to support a structure. A lifting assembly is coupled to each of the plurality of bottom components and the plurality of top components. The lift assembly comprises a plurality of lifting members. Each of the lifting members have a lifting member first end coupled to at least one bottom components of the plurality of bottom components and a lifting second member opposite the lifting member first end coupled to at least one component of the plurality of top components. The lifting assembly further comprises a locking mechanism configured to move between a locked position to selectively lock the lifting assembly in each of a raised configuration, an intermediate position, and a lowered configuration, of the lifting assembly, and an unlocked position to allow the lifting assembly to be moved between the raised configuration, the intermediate configuration, and the lowered configuration. The lift system further comprises a release device selectively engageable with the lifting assembly for moving the lifting assembly between the raised configuration, the intermediate configuration, and the lowered configuration.

It should be appreciated that all combinations of the foregoing concepts and additional concepts discussed in greater detail below (provided such concepts are not mutually inconsistent) are contemplated as being part of the subject matter disclosed herein. In particular, all combinations of claimed subject matter appearing at the end of this disclosure are contemplated as being part of the subject matter disclosed herein.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several implementations in accordance with the disclosure and are therefore, not to be considered limiting of its scope, the disclosure will be described with additional specificity and detail through use of the accompanying drawings.

Figure 1:
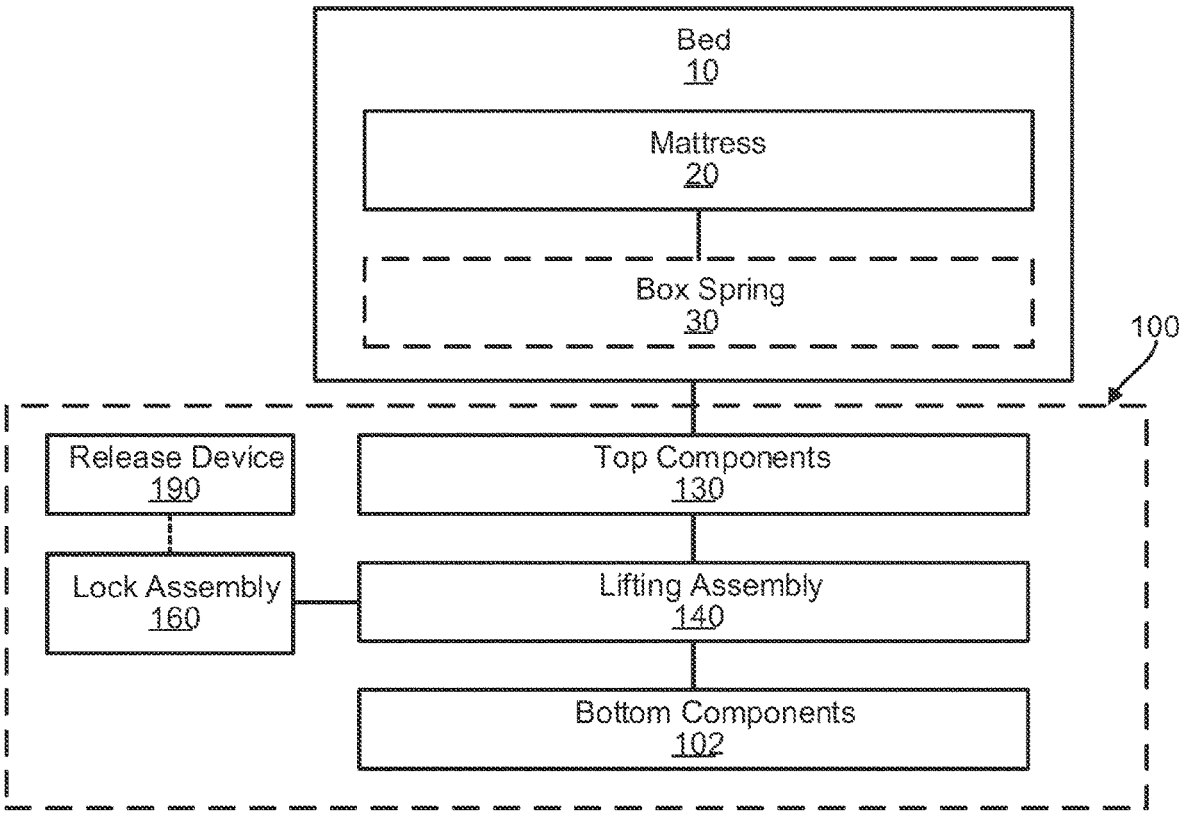
FIG. 1 is a schematic block diagram of a lift system that includes a lifting assembly for raising or lifting a beds upwards from a surface on which the apparatus is positioned, a lock assembly, and a release device, according to an embodiment

Reference is made to the accompanying drawings throughout the following detailed description. In the drawings, similar symbols typically identify similar components, unless context dictates otherwise. The illustrative implementations described in the detailed description, drawings, and claims are not meant to be limiting. Other implementations may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

DETAILED DESCRIPTION

Embodiments described herein relate generally to systems and methods for raising or lifting a bed off or upwards from a surface and in particular, to a lift system that includes a lifting assembly that is configured to be disposed beneath a bed for selectively moving the bed between a lowered configuration and a raised configuration (and, in some embodiments, an intermediate configuration) such that the lifting assembly may be locked in each such configuration. The system also includes a lock assembly that is configured to selectively unlock the lifting assembly when a release device engages the lock assembly so as to allow the lifting assembly, and thereby a bed disposed thereon, to be moved between the lowered configuration and the raised configuration (and, in some embodiments, the intermediate configuration).

Most beds include a bed frame on which a box spring and/or a mattress is disposed. The bed may also include bed sheets, pillows, comforters, etc. disposed on the mattress. For example, a person changing a bed sheet of the mattress often has to bend over so as to make the bed. However, the manual making of the bed (e.g., the bed frame, the box spring and/or mattress) while bending over may pose a number of safety and health issues. For example, frequent or excessive bending over can cause strain on the back and hands of the person making the mattress. The health and safety concern is even higher in settings where bed sheets of mattresses have to be repeatedly changed. For example, in hotel hospitality personnel may have to change numerous bed sheets on any given day.

Various embodiments of the systems and methods of raising and lowering a bed that may include a mattress and, additionally a box spring, a platform, and/or a headboard may provide benefits including, for example: (1) allowing selective raising or lifting of a bed off a surface via a lifting assembly with significantly reduced effort so as to allow a person to facilely change a bed sheet without having to bend over; (2) providing a lock assembly that allows selective unlocking of the lifting assembly in each of a raised configuration and a lowered configuration of the lifting assembly, as well as an intermediate configuration in various embodiments; (3) allowing selective unlocking of the lifting assembly via a release device that can be retained by a user after unlocking the bed, which prevents unauthorized lifting or lowering of the bed; and (4) providing magnetic engagement between the release device and the lock assembly that reduces the effort in unlocking or locking the lifting assembly and is less susceptible to mechanical failure, thereby reducing maintenance costs.

While various embodiments described herein are described with respect to systems for use with beds, the systems described herein can be used for raising and lowering any piece of furniture (e.g., sofas, chests, drawers, love seats, cabinets, etc.), or in industrial settings for raising or lowering any equipment or machine (e.g., palettes, shelves, etc.). All such variations are envisioned and within the scope of the present application.

FIG. 1 is a schematic block diagram of a lift system 100 (also referred to herein as "system 100"), according to an embodiment. The system 100 of FIG. 1 includes a plurality of bottom components (e.g., bottom rails) 102, a lifting assembly 140, a plurality of top components (e.g., top rails) 130 on which a bed 10 may be disposed, a lock assembly 160, and a release device 190. The system 100 may be removably or permanently coupled to the bed 10 (or bed frame).

The plurality of bottom components 102 are configured to be positioned on a surface (e.g., hardwood floor, cemented floor, marbles floor, vinyl floor, carpet, etc.) and may include flat or rigid plates configured to bear a weight of the lifting assembly 140, the plurality of top components 130, and the bed 10. The bottom components 102 may include two axial plates position parallel to each other and that may also be coupled to each other, for example to provide additional mechanical rigidity and strength, as described herein. In some embodiments, the bottom components 102 may be coupled via telescopic or extendable bottom component cross-members configured to adjust a spacing between the bottom components 102, for example, to accommodate beds 10 having various widths (e.g., single, twin, full, queen, king, California king, or any other custom width bed.)

The bed 10 includes a mattress 20 and may also include a box spring 30 and/or a bed frame. The bed 10 may also include other components, for example slats, pillows, bed sheets, decorative sheets, comforters etc. The mattress 20 may include any suitable mattress such as for example a spring mattress, a foam mattress, a memory foam mattress, a gel mattress, a water mattress, an air mattress, or any other suitable mattress. The mattress 20 may have any suitable size, for example, single, twin, full, queen, king, California king, or any other suitable shape or size.

In some embodiments, the box spring 30 is positioned on the plurality of top components 130, for example, on a bed frame coupled to, or disposed on the plurality of top components 130, and the mattress 20 is positioned on the box spring 30. The box spring 30 may comprise any suitable box spring, for example a wooden box spring or any other commonly available box spring. In other embodiments, the box spring 30 may be excluded such that the mattress 20 may be positioned directly on a bed frame or the plurality of top components 130. In such embodiments, slats (e.g., wooden slats) may be positioned on the mattress 20 and/or the bed frame.

The plurality of top components 130 are coupled to corresponding bottom components 102 via the lifting assembly 140, as described herein. The plurality of top components 130 are structured to support the bed 10 thereon. In some embodiments, plurality of top components 130 may include a pair of top components 130 disposed parallel to each other in a first plane, with each top component 130 being disposed parallel to a corresponding bottom component 102 in a second plane that is orthogonal to the first plane.

In various embodiments, each of the plurality of top components 130 may be telescopic or otherwise have an adjustable length so as to accommodate beds having various lengths. In some embodiments, a bed base bracket may be coupled to longitudinal ends of each of the plurality of top components 130 and structured to be coupled to or secure a bed base. In some embodiments, bed frame brackets may be coupled to the plurality of top components 130 for securing a bed frame thereto. In other embodiments, bed base brackets may be additionally, or alternatively, coupled to longitudinal ends of each of the plurality of top components 130 for securing a bed base (e.g., a box spring) disposed on the plurality of top components 130.

In some embodiments, the system 100 may also include a plurality of cross members coupled to opposing top components 130 of the plurality of top components 130 and positioned orthogonal thereto so as to provide mechanical strength and structural rigidity for receiving the bed 10 thereon. Moreover, the cross-members may be telescopic or otherwise, have an adjustable length to allow adjustment of a spacing between adjacent top components 130, for example, as described with respect to the bottom component cross-members.

The lifting assembly 140 is coupled to each of the plurality of bottom components 102 and the plurality of top components 130 and comprises a plurality of lifting members. Each of the plurality of lifting members has a lifting member first end coupled (e.g., pivotally coupled) to at least one bottom component 102 of the plurality of bottom components 102, and a lifting member second end opposite the lifting member first end coupled (e.g., pivotally coupled) to at least one top component 130 of the plurality of top components 130.

The lifting assembly 140 is movable between a raised configuration and a lowered configuration. As discussed in greater detail below, the lifting assembly 140 may also be movable to an intermediate configuration in various embodiments. In the lowered configuration, the lifting member second end of each of the plurality of lifting members is positioned proximate to the plurality of bottom components 102 such that the plurality of top components 130, and thereby the bed 10 positioned thereon, is positioned proximate to the surface (e.g., the floor) on which the plurality of bottom components 102 are positioned. In the raised configuration, the lifting member second end of each of the plurality of lifting members is positioned distal to the plurality of bottom components 102 so that the plurality of top components and, thereby the bed 10 positioned thereon, are raised or lifted upwards off the surface on which the plurality of bottom components 102 are positioned. In the intermediate configuration, the lifting member second end of each of the plurality of lifting members is positioned in an intermediate position between proximate to the bottom components 102 and distal to the bottom components 102, and thereby the bed 10 positioned thereon, is positioned in a configuration in between the lowered configuration and the raised configuration. In some embodiments, the plurality of lifting members may include hydraulic or pneumatic telescopic cylinders configured to move the lifting assembly between the raised and lowered configurations.

The lifting assembly 140 may also include a locking member, which may be coupled to a corresponding lifting member of the plurality of lifting members and configured to move between a locked position to lock the lifting assembly 140 in each of a raised configuration and a lowered configuration (and, in some embodiments, an intermediate configuration) of the lifting assembly 140, and an unlocked position to allow the lifting assembly 140 to be moved between the raised configuration and the lowered configuration (and, in some embodiments, the intermediate configuration). One or more biasing members (e.g., tension springs, a helical springs, an extension springs, a bungee cord, or any other biasing member) may be coupled to one or more of the plurality of lifting members and a corresponding bottom component 102 so as to urge the lifting assembly 140 into the raised configuration (or, in some embodiments, the intermediate configuration), when the locking member is in the unlocked position. In some embodiments, the one or more biasing members may provide sufficient biasing force to lift the bed 10 having a weight in a range of 60 lbs to 600 lbs (e.g., to support a maximum Underwriter's Laboratory approved weight of 300 lbs for a twin bed or 600 lbs for a King or California King bed).

One or more dampers (e.g., a hydraulic shock absorber, a twin tube shock absorber, a mono tube shock absorber, a pneumatic shock absorber, or any other suitable damper) may also be coupled to one or more of the plurality of lifting members and a corresponding bottom component 102, and configured to damp motion of the lifting assembly 140 as it moves from the raised configuration to the lowered configuration (or, in some embodiments, from the raised configuration to the intermediate configuration, or from the intermediate configuration to the lowered configuration). The dampening effect of the damper may reduce the effective weight of the bed 10 to less than 20 lbs as the bed, thereby reducing a chance of injury if the lifting assembly 140 and thereby, the bed 10 is accidentally dropped from the raised to the lowered configuration (or, in some embodiments, from the raised to the intermediate configuration, or from the intermediate to the lowered configuration).

In some embodiments, the locking member may include a locking member body pivotally mounted on the corresponding lifting member at a central portion of the locking member body such that the locking member body is rotatable about its central portion. A first ledge may be defined at a locking member body first end. The first ledge may be configured to engage an upper post-lock, for example, provided on a bracket coupled to a corresponding bottom component 102, in the raised configuration of the lifting assembly so as to secure the lifting assembly in the raised configuration. A second ledge may be defined at a locking member body second end opposite the locking member body first end. The second ledge may be configured to engage a lower post-lock, for example, provided on the corresponding bottom component 102, in the lowered configuration of the lifting assembly 140 so as to secure the lifting assembly 140 in the lowered configuration.

In other embodiments, the first ledge may be configured to engage the upper post-lock, for example provided on a bracket coupled to a corresponding bottom component 102 in the intermediate configuration of the lifting assembly so as to secure the lifting assembly in the intermediate configuration. The second ledge may be configured to engage the lower post-lock in the lowered configuration of the lifting assembly 140 so as to secure the lifting assembly 140 in the lowered configuration. A third ledge may be defined at a locking member body intermediate position in between the locking member body first end and the locking member body second end. The locking member body intermediate position may be or may not be equidistant between the locking member body first end and the locking member body second end. The third ledge may be configured to engage the upper post-lock, for example, provided on a bracket coupled to the corresponding bottom component 102, in the raised configuration of the lifting assembly 140 so as to secure the lifting assembly 140 in the raised configuration.

In some embodiments, the locking member further comprises a locking biasing member coupled to the locking member and configured to selectively urge the locking member into the locked position in each of the raised configuration and the lowered configuration (and, in some embodiments, the intermediate configuration) of the lifting assembly.

The lock assembly 160 is coupled to the lifting assembly 140, for example, at a longitudinal end thereof. The lock assembly 160 includes a lock/unlock member and a linking component (e.g., one or a plurality of cables) coupling the lock/unlock member to the locking member. In some embodiments, the lock assembly 160 may include a lock assembly housing defining an internal volume within which the lock/unlock member is disposed. The lock/unlock member may be a movable member that is normally biased in a first position by the locking biasing member via the linking component, the first position corresponding to the locking member being in the locked position.

The release device 190 is configured to be selectively engaged with the lock/unlock member by a user to cause the lock/unlock member to move the locking member into the unlocked position. The release device 190 may include a release device arm having a release device magnet disposed at a distal end of the release device arm. When the distal end of the release device arm engages the lock assembly 160 the release device magnet urges the lock/unlock member to move towards the release device magnet. The movement of the lock/unlock member pulls the linking component causing the locking member to move into the unlocked position so as to allow the user to move the lifting assembly 140 between the lowered configuration and the raised configuration (and in some embodiments, the intermediate configuration). In some embodiments, the release device 190 instead of including a hook may include a bolt or magnet configured to engage the lock/unlock assembly 160.

In some embodiments, a lock/unlock member magnet is disposed at an end of the lock/unlock member that is proximate to the distal end of the release device arm so as to increase the attractive force between the distal end of the release device arm and the lock/unlock member. In some embodiments, the lock/unlock member comprises a fixed end that is pivotally mounted such that the end on which the lock/unlock member magnet is disposed is a movable end. For example, the lock/unlock member may comprise a pendulum type tumbler configured to move back-to-front or side-to-side towards the distal end of the release device arm. In other embodiments, the lock/unlock member may comprises a slidable member, for example, slidably mounted on a rail.

In some embodiments, the lock assembly housing of the lock assembly defines a cavity or slot configured to receive the distal end of the release device arm. In particular embodiments, the release device comprises a handle coupled to a proximate end of the release device arm that is configured to be engaged by a user. A bend may be defined in the release device arm proximate to the distal end of the release device arm such that the distal end forms a hook that is configured to engage a portion of the lock assembly housing, for example, when the distal end of the release device arm is inserted into the cavity defined in the lock assembly housing. The distal end hooks on to the portion of the lock assembly housing allowing the user to pull the lock assembly 160 and thereby, the lifting assembly from the lowered configuration into the raised configuration, or vice versa.

Figure 2A:
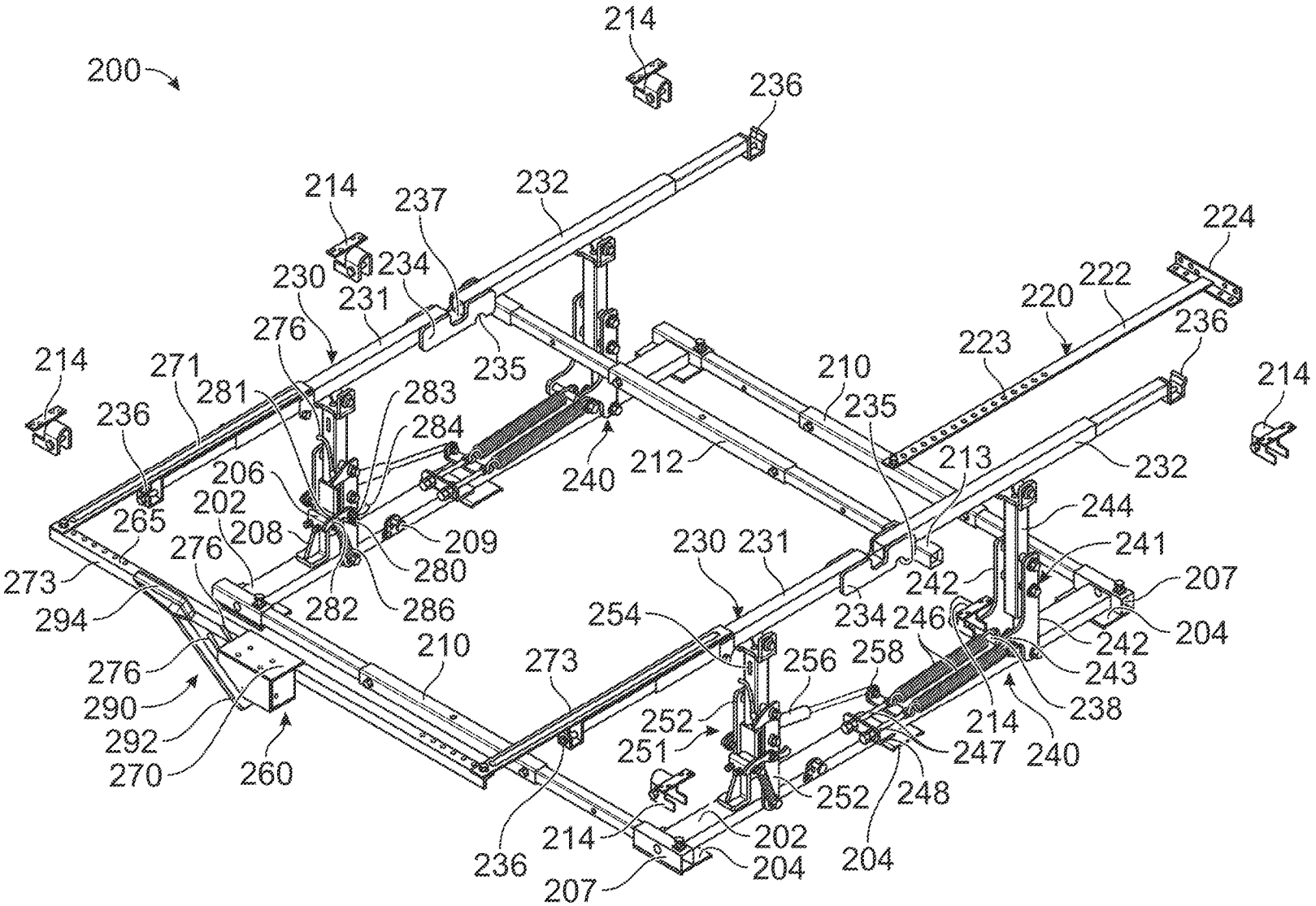
FIG. 2A is a top, front, right perspective view of an embodiment of a lift system in a raised configuration, according to an embodiment.
Figure 2B:
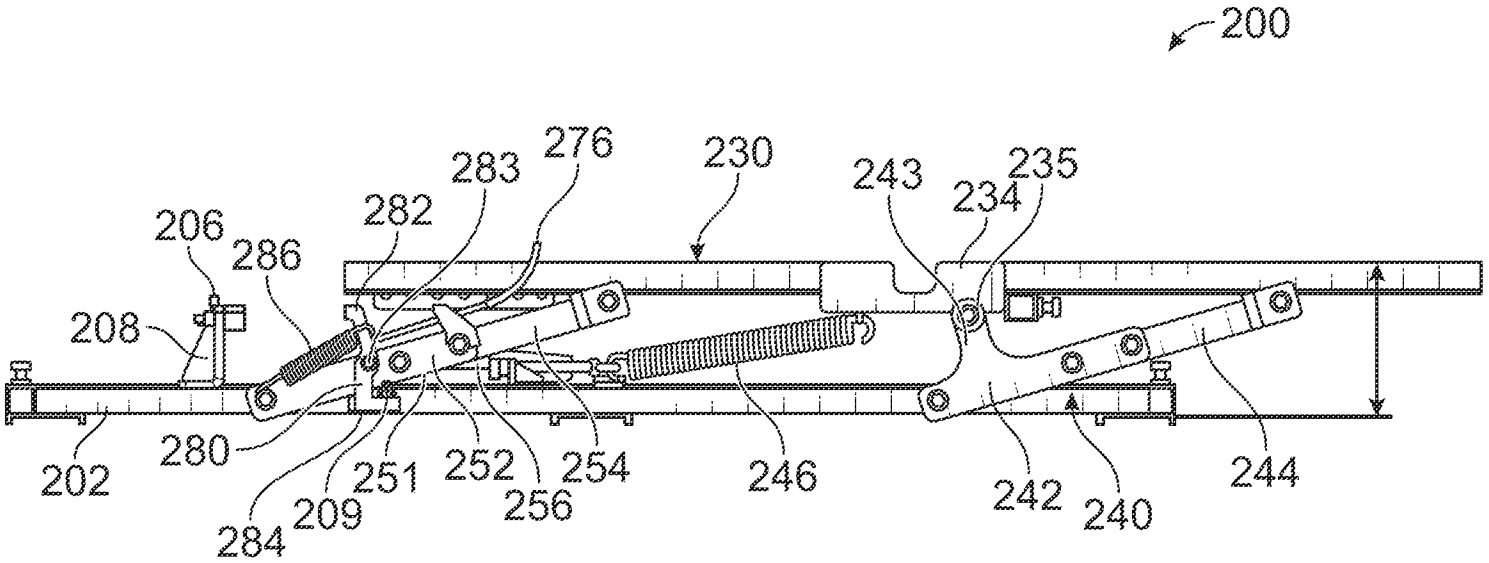
FIG. 2B is side view of a portion of the lift system of FIG. 2A in a lowered configuration.

FIG. 2A is a perspective view of a lift system 200 (hereinafter "system 200") in a raised configuration, and FIG. 2B is a side view of the system 200 in a lowered configuration, according to a particular embodiment. The system 200 includes a set of bottom components 202, a set of top components 230, a lifting assembly 240, a lock assembly 260, and a release device 290. The system 200 may be used to selectively raise a bed (e.g., the bed 10) disposed on the system 200 off a surface (e.g., a floor such as a hardwood floor, a vinyl floor, a marbled floor, a concrete floor, a tiled floor, a carpeted floor, or any other surface on which the system 200 is disposed) or lower the bed towards the surface.

The plurality of bottom components 202 are configured to be positioned on the surface. The plurality of bottom components 202 may include flat plates formed from a strong and rigid material (e.g., metals such as cast iron or stainless steel). As shown in FIG. 2A, the set of bottom components 202 include a pair of bottom components 202 disposed parallel to each other. In other embodiments, the set of bottom components 202 may include larger number of bottom components 202 (e.g., 3, 4, or even more) for example, may include bottom components disposed between the pair of bottom components 202 shown in FIG. 2A. In some embodiments, a plurality of decorative boards (not shown) may be positioned around the plurality of bottom components 202, for example, to prevent a user from seeing the plurality of bottom components 202 and/or the lifting assembly 240 (e.g., for aesthetic purposes).

A plurality of bottom component feet 204 may be disposed beneath the bottom components 202 and coupled thereto. The plurality of bottom component feet 204 configured to support the set of bottom components 202 on the surface. In some embodiments, at least a contact surface of each of the bottom component feet 204 that contacts the surface on which the system 200 is disposed includes a slip resistant material (e.g., a high friction material such as rubber or may include grooves that increase friction) to prevent slipping of the system 200 over the surface as the lifting assembly 240 is moved between a raised configuration and a lowered configuration, as described herein.

A pair of bottom component cross-members 210 are disposed perpendicular to a longitudinal axis defined by each of the set of bottom components 202 and coupled to the pair of bottom components 202. For example, a first one of the pair of bottom component cross-members 210 is coupled to a first longitudinal end of each of the set of bottom components 202, and a second one of the pair of bottom component cross-members 210 is coupled to a second longitudinal end of each of the set of bottom components 202 opposite the first longitudinal end. In some embodiments, bottom component cross-member mounts 207 may be disposed at each of the first and second longitudinal ends, each of which defines a channel configured to receive an end of a corresponding bottom component cross-member 210. The end of the bottom component cross-member 210 may be secured within the channel via securing members (e.g., pins, screws, nuts, rivets, etc.). In some embodiments, the plurality of bottom component cross-members 210 may have an adjustable length, for example, be telescopic so as to allow adjustment of the length of the plurality of bottom component cross-members 210. In this manner, a spacing between the set of bottom components 202 may be adjusted to accommodate beds having different sizes (e.g., single, twin, full, queen, king, California king, or any other suitable shape or size bed).

In some embodiments, the system 200 may include a securement assembly 220 coupled to a bottom component cross-member 210 or to any other member and/or at any location of the system 200. In some embodiments, the securement assembly 220 may be coupled to a bottom component cross-member 210 that is configured to be located proximate to a wall or a headboard (not shown). The securement assembly 220 may include a longitudinal bar 222 coupled at a first end thereof to the bottom component cross-member 210, and having a securement member 224, for example, a bracket or plate, disposed at a second end thereof, opposite the first end. The securement member 224 is configured to be coupled to a wall or the surface on which the system 200 is disposed so as to prevent movement (e.g., sliding) of the system 200 as the lifting assembly 240 is moved between the raised and the lowered configurations.

A plurality of mounting apertures 223 may be defined along the length of the longitudinal bar 222 proximate to the first end of the longitudinal bar 222. The longitudinal bar 222 may be coupled to the bottom component cross-member 210 by inserting a coupling member (e.g., a screw, pin, bolt, rivet, etc.) through any one of the mounting apertures 223 with the choice of mounting aperture 223 determining a length of the longitudinal bar 222 that extends away from the system 200. In this manner, a length of the portion of the longitudinal bar 222 that extends away from the bottom component cross-member 210 can be adjusted to account for an amount of space available between the system 100 and the wall or head board.

Each top component 230 of the set of top components 230 is coupled to corresponding bottom component 202 of the set of bottom components 202, as described herein. As shown in FIG. 2A, the set of top components 230 includes a pair of top components 230 coupled to a corresponding bottom component 202 of the pair of bottom components 202. In some embodiments, each top component 230 includes a top component first portion 231 and a top component second portion 232 coupled to each other via a coupling bracket 234. Each of the top component first portion 231 and the top component second portion 232 may be telescopic, thereby allowing adjustment of a length of each top component 230 for accommodating various size beds. A top component coupling bracket slot 237 may be defined in each of the top component coupling brackets 234 and structured to receive at least a portion of an orthogonal beam, for example, an orthogonal beam included in a support assembly 500*a* as described with respect to FIG. 5A.

In some embodiments, bed base mounting brackets 236 may be disposed on the longitudinal ends of each of the plurality of top components 230. The bed base mounting brackets 236 are structured to be coupled to a bed base (e.g., a box spring, or slats) to secure the bed base to the top components 230. In other embodiments, the system 200 may also include frame mounting brackets 214 configured to couple a bed frame and, in some embodiments, side boards to the set of top components 230.

In some embodiments, the system 200 may also include a one or more top component cross members 212 coupled to opposing top components 230 of the set of top components 230 and positioned orthogonal thereto so as to provide mechanical strength and structural rigidity for receiving the bed thereon. For example, top component cross-member mounting members 213 may be disposed on each top component 230 and define a channel for receive a respective longitudinal lend of the one or more top component cross-members 212. The one or more top component cross-members 212 may be coupled to the corresponding top component cross-member mounting member 213 via a friction fit, a snap fit, or using a coupling member (e.g., pins, screws, bolts, rivets, etc.) Moreover, the one or more top component cross-members 212 may be telescopic or otherwise, have an adjustable length to allow adjustment of a spacing between adjacent top components 230, for example, as described with respect to the bottom component cross-members 210.

The lifting assembly 240 is coupled to each of the plurality of bottom components 202 and the plurality of top components 230 and comprises a plurality of lifting members each having a lifting member first end pivotally coupled to at least one bottom component 202 of the plurality of bottom components 202, and a lifting member second end opposite the lifting member first end pivotally coupled to at least one top component 230 of the plurality of top components 230. For example, as shown in FIG. 2A, the plurality of lifting members include a first set of lifting members 241 disposed proximate to the securement assembly 220 and a second set of lifting members 251 disposed distal from the securement assembly 220.

The first set of lifting members 241 includes a first portion comprising a pair of first lifting member plates 242 disposed proximate to a corresponding bottom component 202 and pivotally coupled to the corresponding bottom component 202 at first lifting member plate first ends. The first lifting member plates 242 are disposed on either side of the corresponding bottom component 202 such that the bottom component 202 is interposed therebetween. The first set of lifting members 241 also include a second portion comprising a first strut 244 fixedly coupled at a first strut first end to first lifting member plate second ends opposite the first lifting member plate first ends, and having a first strut second end opposite the strut first end pivotally coupled to a corresponding top component 230.

Each of the pair of first lifting member plates 242 also include a first lifting member plate projection 243 extending orthogonally away from a longitudinal axis of the first lifting member plate 242 and in a direction away from the securement assembly 220. The lifting assembly 240 also includes one or more lifting assembly biasing members 246. The biasing members 246 may comprise, for example, a tension spring, a helical spring, an extension spring, a bungee cord, or any other biasing member. A first end of the one or more lifting assembly biasing members 246 is coupled to a corresponding first lifting member plate 242, for example, to the first lifting member plate projection 243, and a second end of the lifting assembly biasing member 246 is coupled to the corresponding bottom component 202.

A tensioning member 247 may be operatively coupled to the second end of each of the lifting assembly biasing member 246 and structured to couple the second end of the lifting assembly biasing member 246 to the corresponding bottom component 202, for example, to a tensioning member mounting bracket 248 coupled to the corresponding bottom component 202. The tensioning member 247 may be configured to adjust the biasing force of the at least one lifting assembly biasing member 246. For example, the tensioning member 247 may include a slidable or otherwise movable coupling.

The tensioning member 247 may be configured to move the coupling location of the second end of the lifting assembly biasing member 246 closer to or further away from the first end of the lifting assembly biasing member 246. This may adjust a tension in the lifting assembly biasing member 246 (e.g., a tension spring) by extending or shortening a length of the lifting assembly biasing member 246, thereby adjusting a biasing force exerted by the lifting assembly biasing member 246 on the first set of the lifting members 241.

The one of more biasing members 246 are configured to apply a tensioning force on the first set of lifting members 241 so as to urge the lifting assembly 240 towards the raised configuration. While FIG. 2A shows two lifting assembly biasing members 246 located on each of the pair of bottom components 202, in other embodiments the lifting assembly 240 may only include a single lifting assembly biasing member 246 per bottom component 202. In this manner, the number of lifting assembly biasing members 246 can be increased or decreased, and/or a tension in each of the lifting assembly biasing member 246 may be adjusted to control an amount of tension exerted on the first set of lifting members 241 so as to allow lifting of a bed having a weight in a range of 60 lbs to 600 lbs (e.g., to support a maximum Underwriter's Laboratory approved weight of 300 lbs for a twin bed or 600 lbs for a King or California King bed).

The second set of lifting members 251 also includes a first portion comprising a pair of second lifting member plates 252 disposed proximate to a corresponding bottom component 202 and pivotally coupled to the corresponding bottom component 202 at second lifting member plate first ends. The second lifting member plates 252 are disposed on either side of the corresponding bottom component 202 such that the bottom component 202 is interposed therebetween. The second set of lifting members 241 also include a second portion comprising a second strut 254 fixedly coupled at a second strut first end to second lifting member plate second ends opposite the second lifting member plate first ends, and having a second strut second end opposite the second strut first end pivotally coupled to a corresponding top component 230.

The lifting assembly 240 also includes a damper 256 (e.g., a hydraulic shock absorber, a twin tube shock absorber, a mono tube shock absorber, a pneumatic shock absorber, or any other suitable damper). A damper first end of the damper 256 is coupled to one of the second lifting member plates 252, and a damper second end of the damper 256 opposite the damper first end is coupled to the corresponding bottom component 202 proximate to the second end of the corresponding lifting assembly biasing member 246, for example, via damper mounting bracket 258. The damper 256 is configured to damp motion of the lifting assembly 140 as it moves from the raised configuration to the lowered configuration. The dampening effect of the damper may reduce the effective weight of the bed 10 to less than 20 lbs, thereby reducing a chance of injury if the lifting assembly 140 is accidentally moved from the raised to the lowered configuration.

As previously described, the lifting assembly 240 is movable between the raised configuration shown in FIG. 2A and the lowered configuration shown in FIG. 2B. In the lowered configuration, the first strut second end and the second strut second end is positioned proximate to the corresponding bottom components 202 such that the plurality of top components 230, and thereby the bed positioned thereon, is positioned proximate to the surface (e.g., the floor) on which the plurality of bottom components 202 are positioned. The top component coupling bracket 234 may include a slot 235 that is configured to, for example, receive a portion of a limit pin 238 so as to limit motion of the lifting assembly 240 as it moves from the raised configuration to the lowered configuration.

In the raised configuration, the first strut second end and the second strut second end are positioned distal to the plurality of bottom components 202 so that the plurality of top components 230, and thereby the bed positioned thereon, are raised or lifted upwards off the surface on which the plurality of bottom components 202 are positioned. The lifting assembly biasing members 246 bias the lifting assembly 240 towards the raised configuration facilitating lifting of the lifting assembly 240 towards the raised configuration. Moreover, the damper 256 dampens downwards motion of the lifting assembly 240 towards the lowered configuration, thereby preventing accidental dropping of the bed from the raised to the lowered configuration that can cause injury.

The lifting assembly 240 also includes a locking member 280 coupled to the second set of lifting members 251, for example, to a corresponding second lifting member plate 252. The locking member 280 is configured to move between a locked position to lock the lifting assembly 240 in each of a raised configuration and a lowered configuration of the lifting assembly 240, and an unlocked position to allow the lifting assembly 240 to be moved between the raised configuration and the lowered configuration.

The locking member 280 may include a locking member body 281 pivotally mounted on the corresponding second lifting member plate 252 at a central portion 283 of the locking member body 281 such that the locking member body 281 is rotatable about its central portion 283. A first ledge 282 (e.g., a hook) is defined at a locking member body first end. The first ledge 282 is configured to engage an upper post-lock 206 (e.g., a first pin) in the raised configuration of the lifting assembly 240 so as to secure the lifting assembly 240 in the raised configuration. The upper post-lock 206 is mounted on a bumper foot hinge 208 that elevates the upper post-lock 206 such that as the locking member 280 raises with the raising of the lifting assembly 240, the first ledge 282 is able to engage the upper post-lock 206.

A second ledge 284 is defined at a locking member body second end opposite the locking member body first end. The second ledge 284 is configured to engage a lower post-lock 209 provided on the corresponding bottom component 202, in the lowered configuration of the lifting assembly 240 so as to secure the lifting assembly 240 in the lowered configuration. The first ledge 282 extends in a first orthogonal direction away from the locking member body 281, and the second ledge 284 extends in a second orthogonal direction away from the locking member body 281, which is opposite the first orthogonal direction. This allows the locking member 280 to rotate about its central portion 283 to cause the first ledge 282 and the second ledge 284 to either engage or disengage the upper post-lock 206 and the lower post-lock 209, respectively. In some embodiments, a height of the lower post-lock 206 may be adjustable up or down so as to accommodate variances in minimum heights of a bed and/or bed frame disposed on the system 200.

The locking member 280 further comprises a locking biasing member 286 coupled to the locking member 280 and configured to urge the locking member 280 into the locked position in each of the raised configuration and the lowered configuration of the lifting assembly 240. For example, a first end of the locking biasing member 286 is coupled to the corresponding bottom component 202 and a second end of the locking biasing member 286 is coupled to a portion of the locking member body 281 proximate to the first ledge 282 and offset from the central portion 283. This causes the tension force exerted by the locking biasing member 286 on the locking member 280 to rotate about its central portion 283 towards the locked position in each of the raised and lowered configurations of the lifting assembly 240.

The lock assembly 260 is operatively coupled to the lifting assembly 240. For example, the lock assembly 260 may be coupled to a longitudinal end of the system 200, for example, to the pair of top components 230. As shown in FIG. 2A, a pair of lock assembly coupling arms 271 are coupled to a corresponding top components 230 and extend longitudinally away therefrom. A lock assembly coupling cross-bar 273 is positioned perpendicular to the pair of lock assembly coupling arms 271 and coupled at its longitudinal ends thereto, for example, via coupling members. The lock assembly 260 is coupled to the lock assembly cross-bar 273 via a lock assembly mounting bracket 270.

Figure 3A:
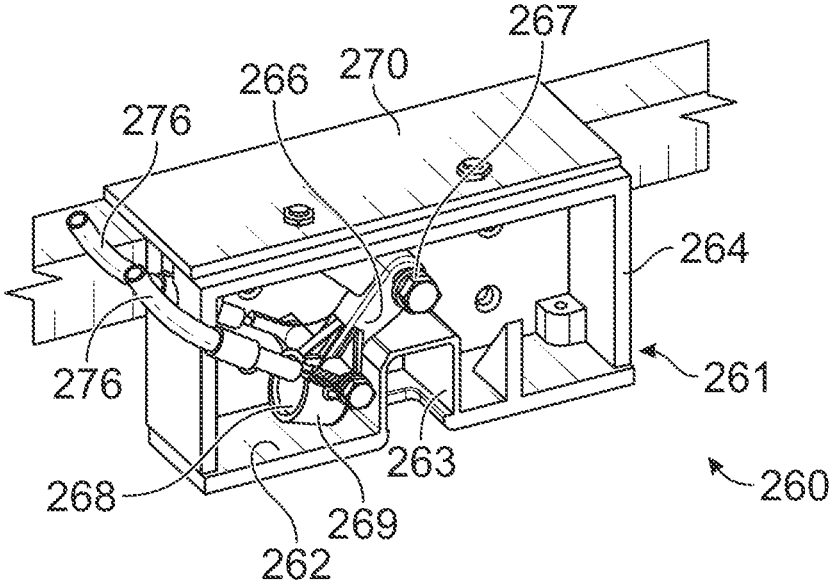
FIG. 3A is front cross-sectional view of the lock assembly included in the system of FIGS. 2A-2B in a first configuration, according to an embodiment.
Figure 3B:
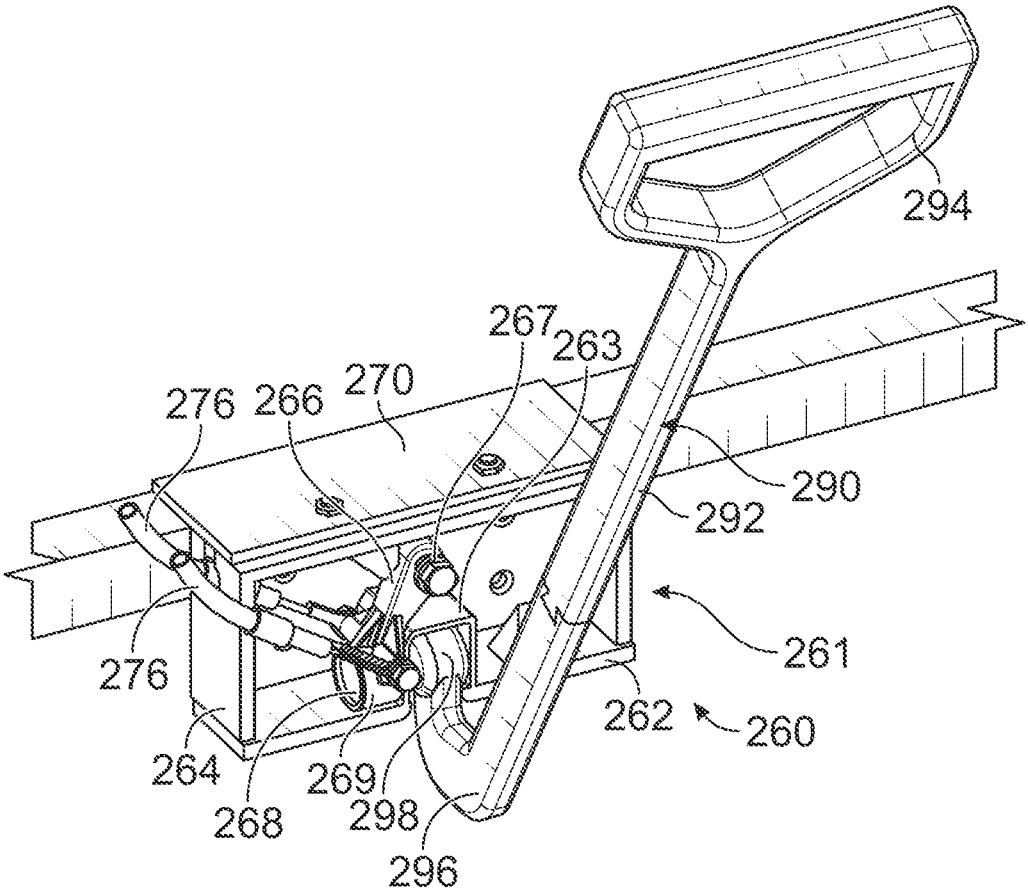
FIG. 3B is another cross-sectional view of the lock assembly of FIG. 3A in a second configuration in which the lock assembly is engaged by a release device.

Referring to FIGS. 3A-3B, the lock assembly 260 includes a lock assembly housing 261 defining an internal volume within which components of the lock assembly 260 are disposed. The lock assembly housing 261 may include a housing base 262 coupled to a housing portion 264 so as to form the lock assembly housing 261. The housing base 262 may be shaped so as to define a cavity 263 for receiving a distal end of the release device 290. The lock assembly 260 includes a lock/unlock member 266, and a set of cables 276 (e.g., one or a plurality of cables) coupling the lock/unlock member 266 to the locking member 280.

The lock/unlock member 266 is pivotally mounted at a lock/unlock member first end 267 within the lock assembly housing 261. A lock/unlock member second end 269 opposite the lock/unlock member first end 267 is free such that the lock/unlock member 266 can swing about the lock/unlock member first end 267 causing the lock/unlock member second end 269 towards or away from the cavity 263. In some embodiments, the lock/unlock member 266 may include a pendulum type tumbler configured to swing side-to-side as shown in FIG. 3A-3B. In other embodiments, the lock/unlock member 266 may be configured to move front-to-back. In still other embodiments, the lock/unlock member 266 may be slidable member, for example, mounted on a rail.

A first end of the set of cables 276 is coupled to the movable lock/unlock member second end 269 of the lock/unlock member 266. The second end of the set of cables 276 opposite the first end is coupled to the locking member 280 at a location on the locking member body 281 proximate to where the locking biasing member 286 is coupled to locking member body 281. The biasing force of the locking biasing member 286 is configured to bias the lock/unlock member second end away from cavity 263 in the unlocked position of the locking member 280.

The release device 290 is configured to be selectively engaged with the lock/unlock member 266 by a user to cause the lock/unlock member 266 to move the locking member 280 into the unlocked position. For example, as shown in FIGS. 3A-3B, the release device 290 includes a release device arm 292 having a release device magnet 298 disposed at a distal end of the release device arm 292. The release device 290 comprises a handle 294 coupled to a proximate end of the release device arm 292 that is configured to be engaged by the user for handling the release device 290. In some embodiments, release device arm may include two or more portions that are separable from each other, so as to allow compact storage of the release device 290.

The distal end, and thereby the release device magnet 298, is configured to be inserted into the cavity 263 while remaining outside the internal volume defined by the housing 261. The attractive force of the release device magnet 298 urges the lock/unlock member second end 269 towards the cavity 263 (e.g., towards an outer wall of the cavity 263 located within the internal volume of the housing 261. In some embodiments, a lock/unlock member magnet 268 is disposed at the lock/unlock member second end 269 so as to increase the attractive force between the distal end of the release device arm 292 and the lock/unlock member second end 269. Movement of the lock/unlock member second end 269 pulls the set of cables 276 and thereby, the locking member 280 into the unlocked position allowing the lifting assembly 240 to be moved between the raised configuration and the lowered configuration.

A bend 296 is defined in the release device arm 292 proximate to the distal end of the release device arm 292 such that the distal end forms a hook that is configured to engage a portion of the lock assembly housing 261, for example, a portion of a side wall of the cavity 263. The distal end hooks on to the portion of the housing 261 allowing the user to pull the housing 261, and thereby the lifting assembly 240, from the lowered configuration into the raised configuration, or push the housing 261 and thereby, the lifting assembly 240 into the lowered configuration. The bend 296 may define angle and/or the release device arm 292 may have a length that allows the user to activate the lock assembly 260 using the release device while the user is in a standing position. In some embodiments, the bend 296 may have an angle in a range of about 70 degrees to about 110 degrees (e.g., 70 degrees, 80 degrees, 90 degrees, 100 degrees, or 110 degrees, inclusive). In some embodiments, the release device arm 292 may have an adjustable length so as to accommodate users having different heights.

The release device 290 thus serves the dual purpose of serving as a key for moving the locking member 280 into the unlocked position, as well as a handle to facilitate a user in moving the lifting assembly 240 between the raised configuration and the lowered configuration. Moreover, since the release device 290 is removable, the user can take and store the release device 290, for example, once the user has made the bed and moved the lifting assembly 240 and thereby the bed into the lowered configuration so as to prevent unauthorized manipulation of the lifting assembly 240.

Figure 4:
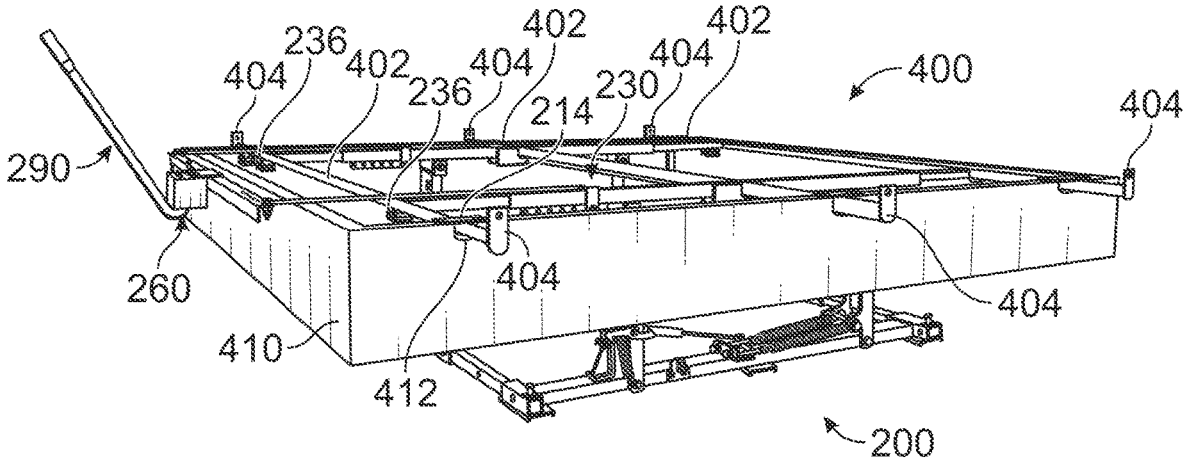
FIG. 4 is top, front, right perspective view of the lift system of FIGS. 2A-2B with a hospitality style bed base coupled thereto, according to an embodiment.

Various attachments can be coupled to the system 200 or any other system described herein to accommodate various beds or configurations of beds. For example, FIG. 4 is a perspective view of the system 200 showing a hospitality style bed base 400 (hereinafter "bed base 400") coupled to the system 200. The bed base 400 may include set of orthogonal beams 402 oriented perpendicular to a longitudinal axis of the system 200 and coupled to the longitudinal ends of each of the top components 230 via the bed base mounting brackets 236. First flanges 404 extend from an axial end of the orthogonal beams 402 and configured to house a bed (e.g., a box spring or a mattress) therebetween. The bed base 400 may be coupled to the top components 230, for example, via the bed base mounting brackets 236. The bed base 400 may also include a bed frame 410 coupled to the orthogonal beams 402 and/or the top components 230 via the bed frame mounting brackets 214. Slots 412 may be defined in the bed frame 410 within which corresponding portions of the orthogonal beams 402 may be disposed such that the bed may be disposed on the bed frame 410.

Figure 5A:
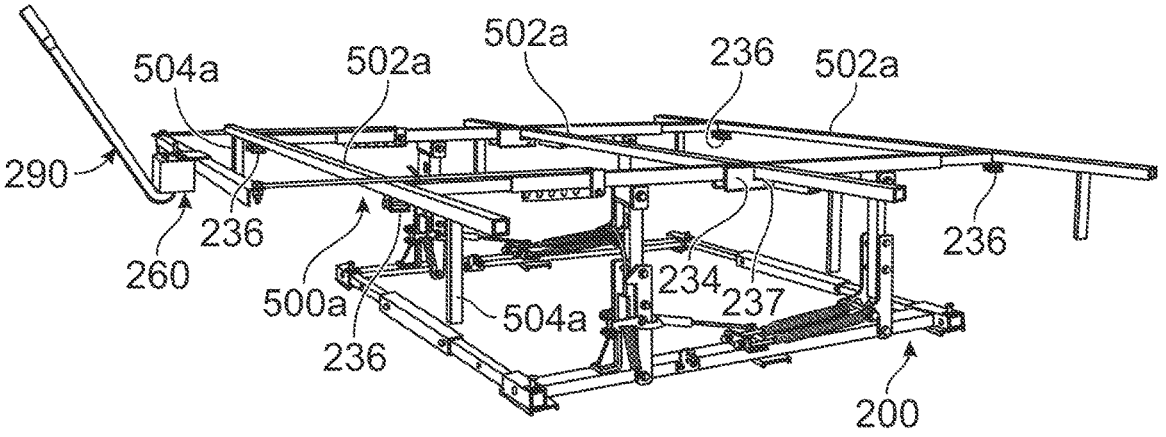
FIG. 5A is a top, front, right perspective view of the lift system of FIGS. 2A-2B with a plurality of orthogonal bars coupled thereto for directly attaching to box springs or platforms, according to another embodiment.

FIG. 5A is a perspective view of a support assembly 500*a* coupled to the system 200, which is structured to mount a box spring or a platform. The support assembly 500*a* includes a plurality of orthogonal beams 502*a* oriented perpendicular to the top components 230 and coupled thereto. For example, an orthogonal beam 502*a* may be coupled to each longitudinal end of the top components 230 via the bed base mounting brackets 236, and one orthogonal beam 502*a* may be disposed across through each of the top component coupling bracket slots 237. Each of the orthogonal beams 502*a* include legs 504*a* extending perpendicular to the orthogonal beams 502*a* from a location proximate to axial ends of the orthogonal beams 502*a* towards a surface on which the system 200 is disposed. The legs 504*a* are structured to support the bed in the lowered configuration of the lifting assembly 200. In some embodiments, each of the orthogonal beams 1002*a* include extensions extending beyond the lifting assembly 200. The extensions are configured to adjust a spacing of the support assembly 500*a*, for example, to accommodate a box spring or platform having various widths. A box spring can be directly coupled to the orthogonal beams via coupling members (e.g., screws, bolts, nuts, rivets, etc.) or any other suitable coupling mechanism.

Figure 5B:
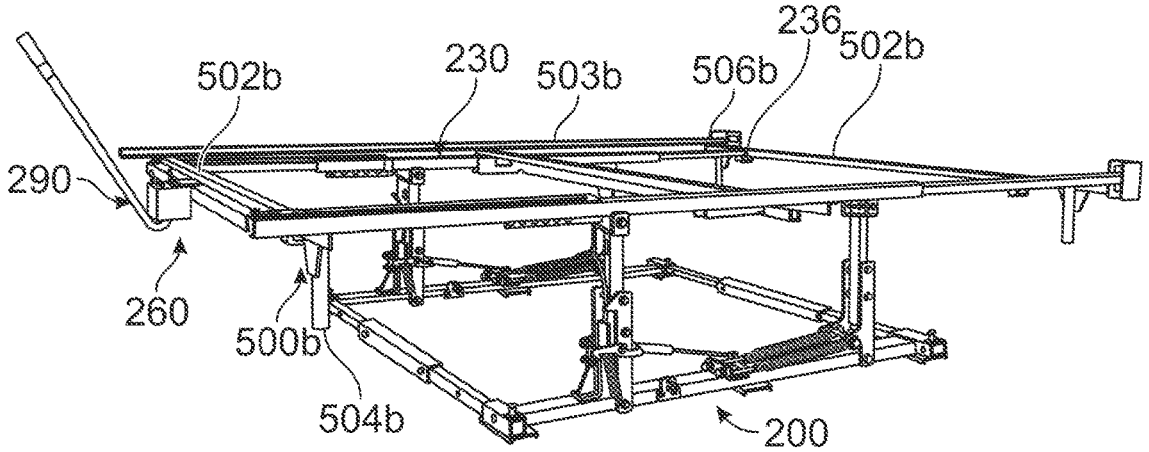
FIG. 5B is a top, front, right perspective view of the lift system of FIGS. 2A-2B having a bed frame coupled thereto, according to an embodiment.

FIG. 5B is a perspective view of a bed frame 500*b* coupled to the system 200. The bed frame 500*b* includes a set of orthogonal beams 502*b* coupled to longitudinal ends of the top components 230 via the bed base mounting brackets 236 and oriented perpendicular to the top components 230. A set of longitudinal beams 503*b* are coupled to axial ends of the orthogonal beams 502*b* and configured to support a bed (e.g. a box spring and/or a mattress thereon). Bed frame brackets 506*b* are disposed at corners of the bed frame located at a longitudinal end of the bed frame 500*b* opposite the lock assembly 260, and are configured to prevent slipping of the bed (e.g., a box spring or a mattress) off the bed frame 500*b*. Moreover, each of the orthogonal beams 502*b* include legs 504*b* extending perpendicular to the orthogonal beams 502*b* from a location proximate to axial ends of the orthogonal beams 502*b* towards a surface on which the system 200 is disposed. The legs 504*b* are structured to support the bed in the lowered configuration of the lifting assembly 200.

Figure 6:
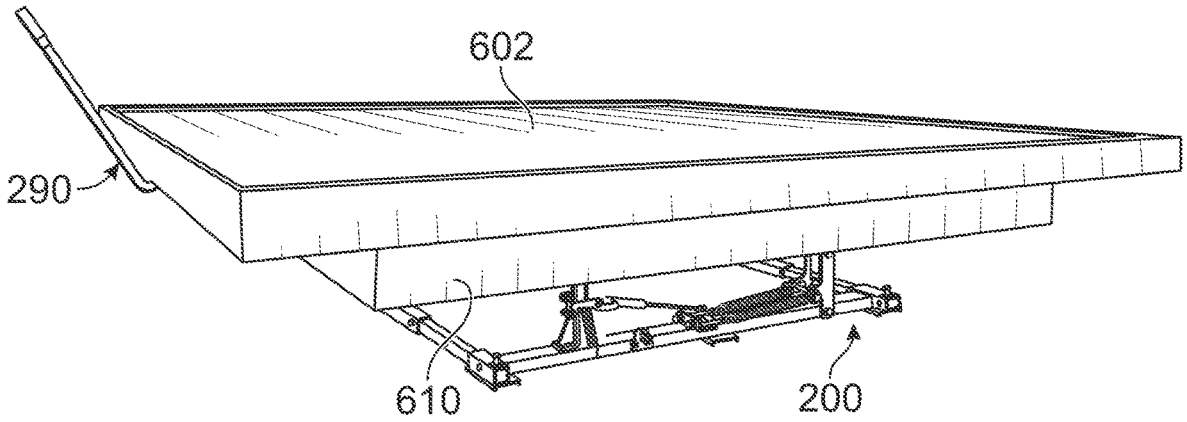
FIG. 6 is a top, front, right perspective view of the lift system of FIGS. 2A-2B with a bed platform disposed thereon, according to another embodiment.

FIG. 6 shows a perspective view of the system 200 according to another arrangement in which a platform 602 is disposed on the system 200, for example, on the set of top components 230, and is configured to receive a bed thereon, such that a box spring is not used (e.g., in a low platform bed configuration). Side boards 610 may also be disposed around the set of top components 230, and the platform 602 disposed thereon.

Figure 7:
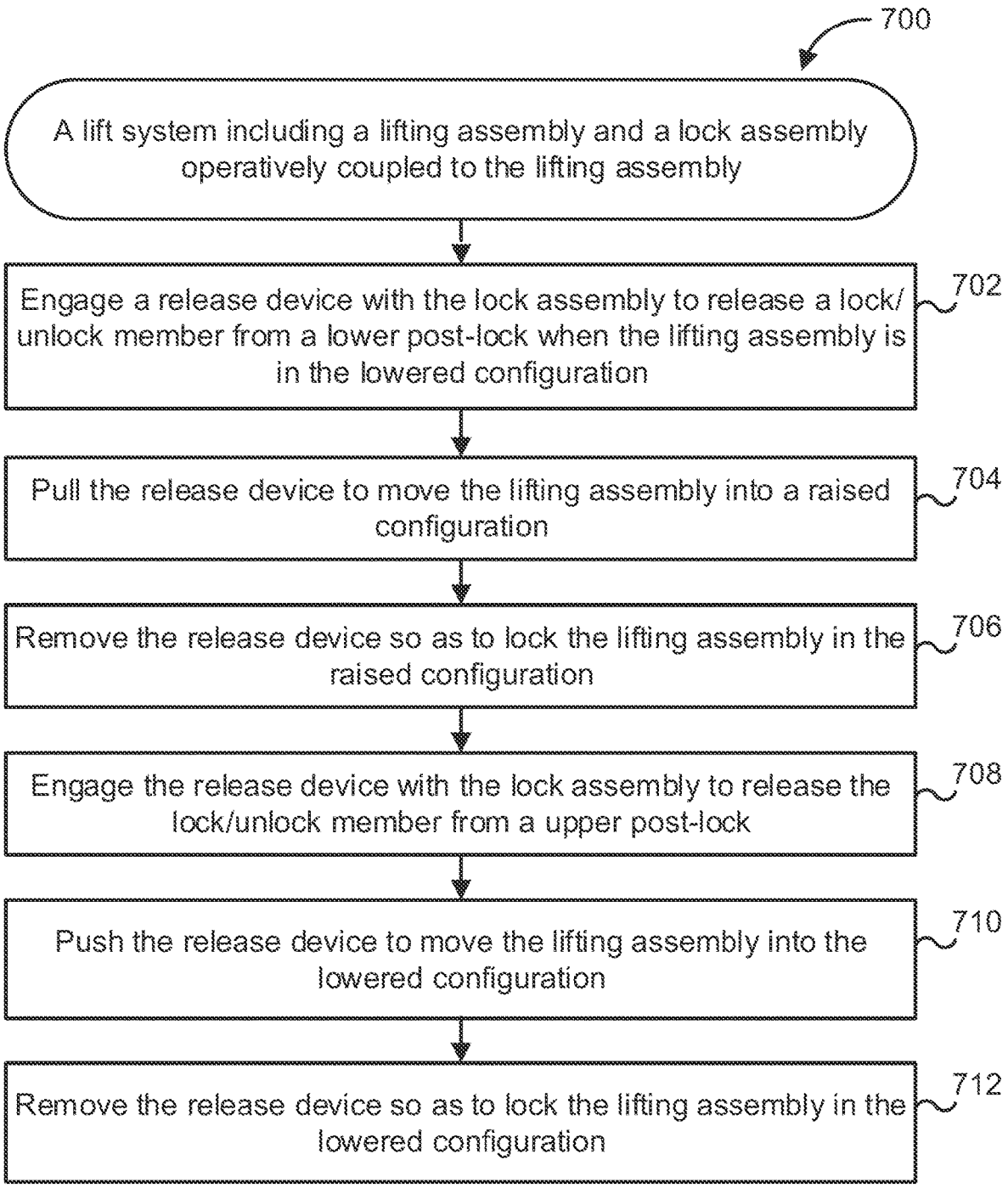
FIG. 7 is a schematic flow diagram of an example method for moving a lifting assembly between a raised configuration and a lowered configuration, according to an embodiment.

FIG. 7 is a schematic flow diagram of an example method 700 for raising or lowering a bed using a lift system 100, 200 that includes a plurality of bottom components 102, 202 disposed on a surface, a plurality of top components 130, 230 coupled to the plurality of bottom components 102, 202 via a lifting assembly 140, 240, and also includes a lock assembly 160, 260, and a release device 190, 290. A bed (e.g., the bed 10) may be disposed on the system 100, 200.

The method 700 includes engaging the release device 190, 290 with the lock assembly 160, 260 to release the locking member 280 from a catch (e.g., the lower post-lock 209) when the lifting assembly 140, 240 is in the lowered configuration, at 702. At 704, the release device 190, 290 is pulled (e.g., via the handle 294) by a user to move the lifting assembly 140, 240 into the raised configuration, thereby lifting the bed off the surface on which the system 100, 200 is disposed. At 706, the release device 190, 290 is removed from the lock assembly to lock the lifting assembly 140, 240 in the raised configuration, for example, via the locking member 280 engaging another catch (e.g., the upper post-lock 206). A user may be make the bed while the bed is in the raised configuration.

At 708, the user engages the release device 190, 290 with the lock assembly 160, 260 to release the locking member 280 from the other catch (e.g., the upper post-lock 206). At 710, the user pushes the release device 190, 290 forward to urge the lifting assembly 140, 240 and thereby, the bed into the lowered configuration. For example, when the lifting assembly 140, 240 is in the raised configuration, the plurality of lift members 241, 251 may be oriented at an angle which is a few degrees greater than 90 degrees relative to the plurality of bottom components 102, 202 (e.g., in a range of 1 degrees to 3 degrees past 90 degrees). To move the lifting assembly 140, 240 into the lowered configuration, the user may simply give the bed 10 disposed on the system 100, 200 a gentle push until the plurality of lifting members 140, 240 are oriented at an angle less than 90 degrees relative to the plurality of bottom components 102, 202. At this point, the weight of the bed 10 causes the lifting assembly to slowly move into the lowered configuration without any assistance from the user.

At 712, the user removes the release device 190, 290 from the lock assembly 160, 260 to lock the lifting assembly 140, 240 in the lowered configuration.

Figure 8A:
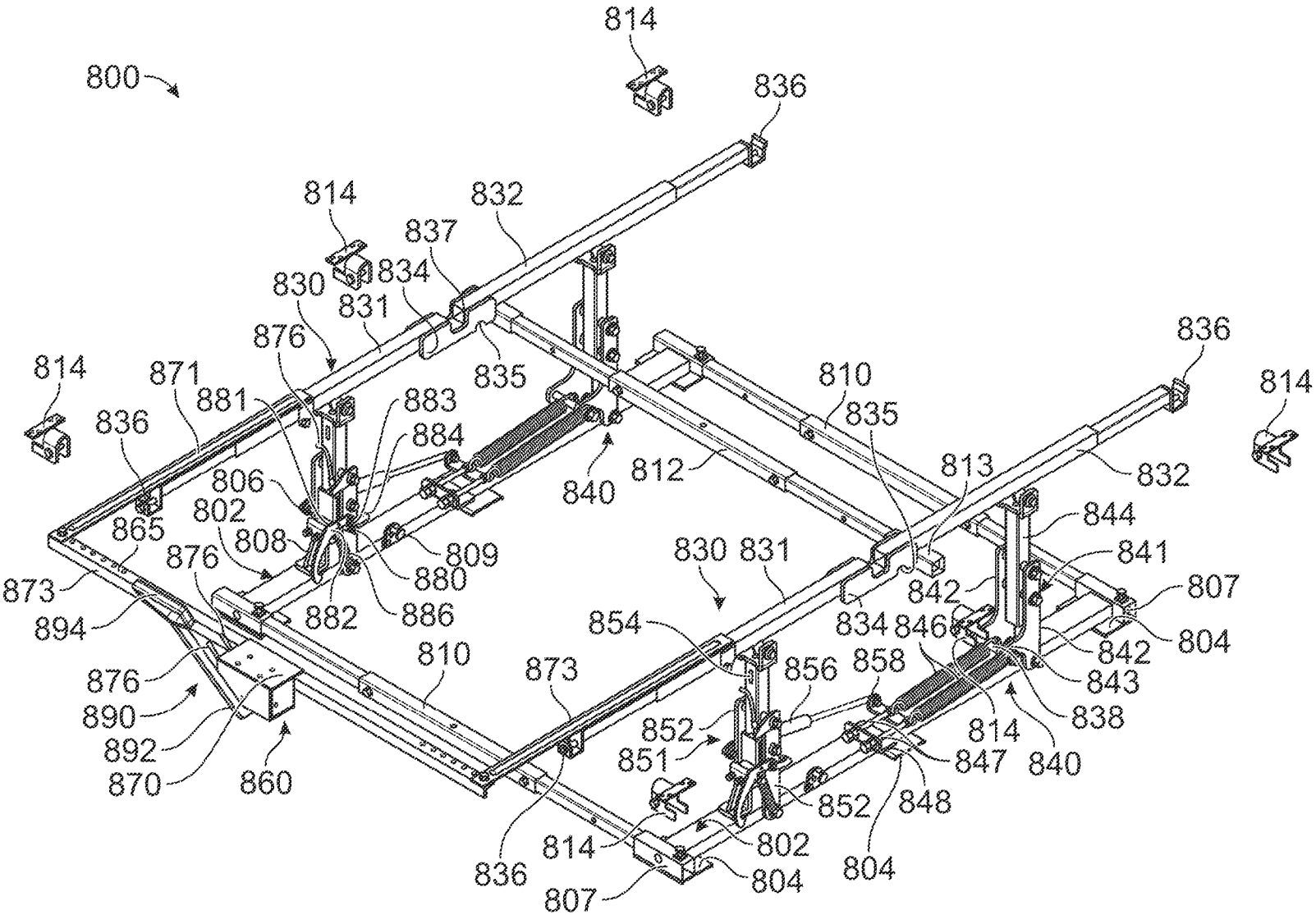
FIG. 8A is a top, front, right perspective view of a lift system in a raised configuration, according to an embodiment.
Figure 8B:
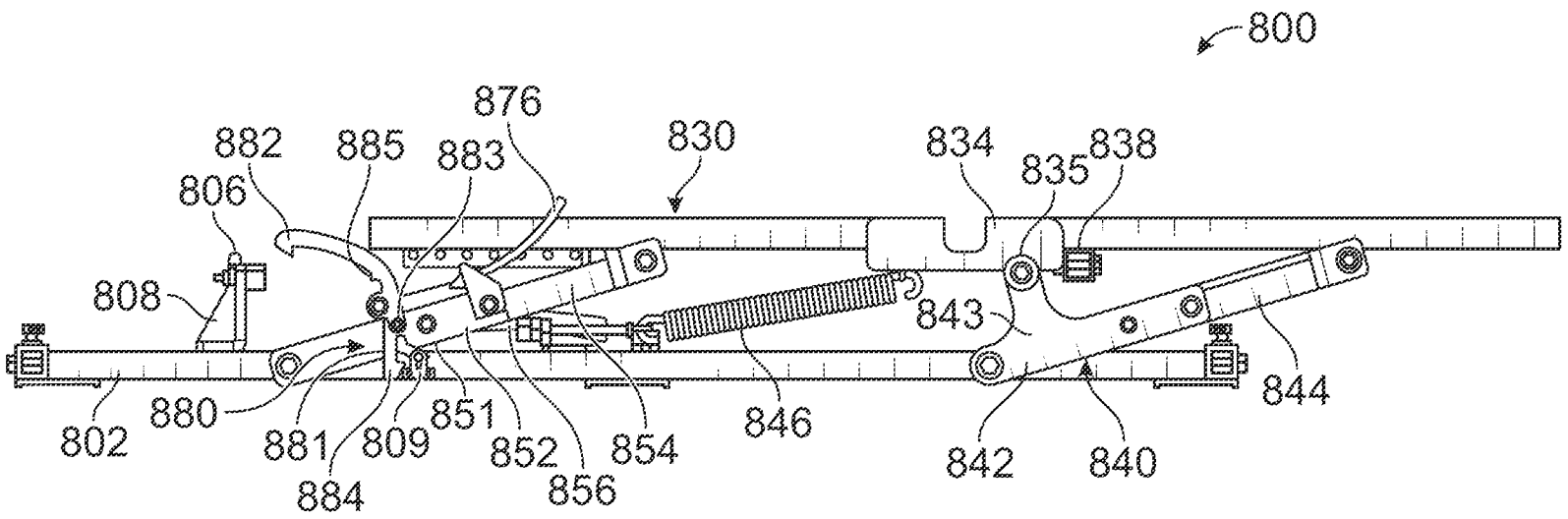
FIG. 8B is side view of a portion of the lift system of FIG. 8A in a lowered configuration.
Figure 8C:
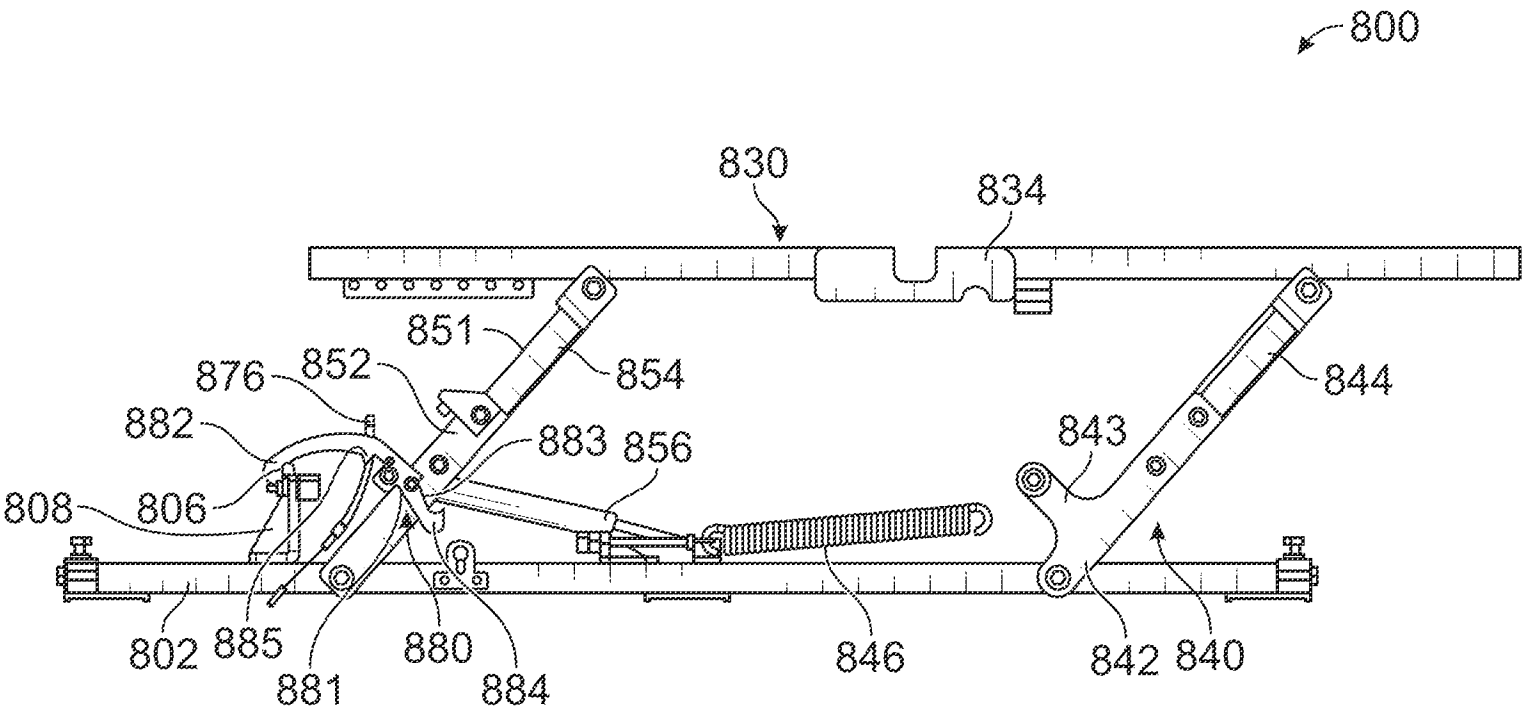
FIG. 8C is side view of a portion of the lift system of FIG. 8A in an intermediate configuration.
Figure 8D:
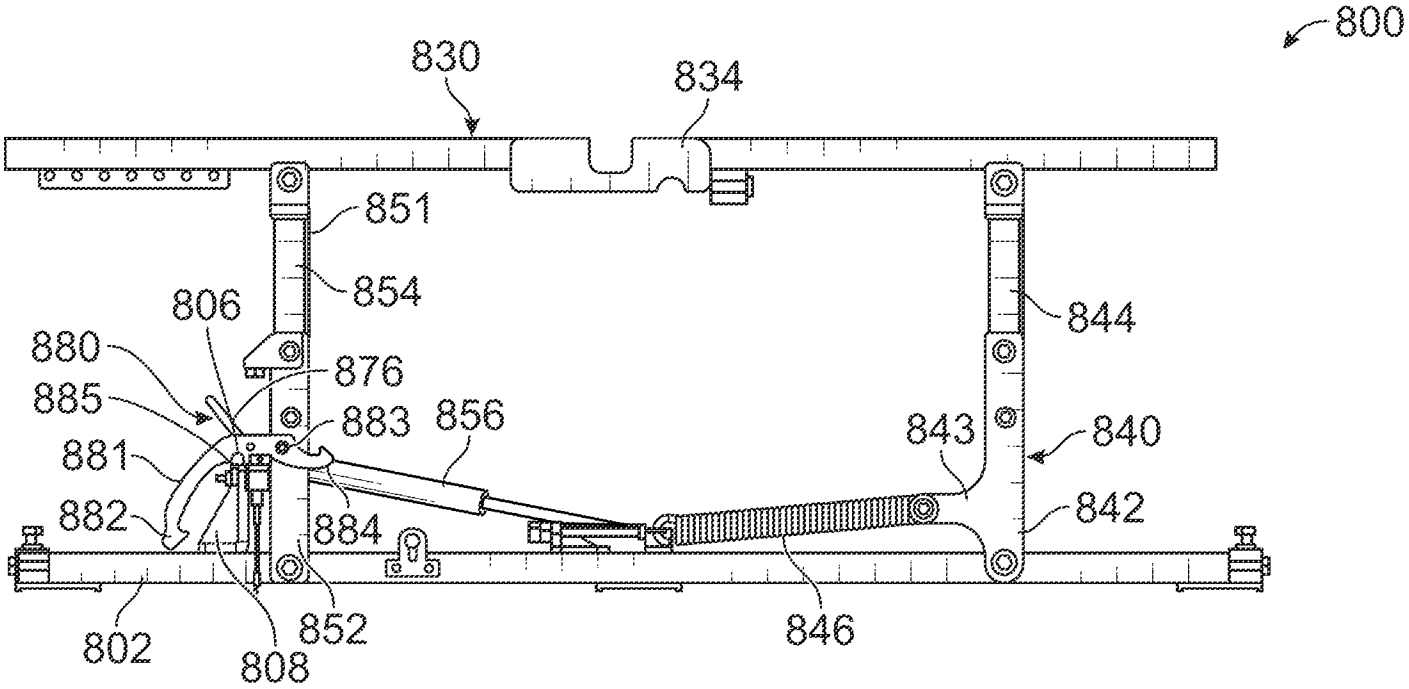
FIG. 8D is side view of a portion of the lift system of FIG. 8A in a raised configuration.

FIG. 8A is a perspective view of a lift system 800 (hereinafter "system 800") in a raised configuration, and FIG. 8B is a side view of the system 800 in a lowered configuration, according to a particular embodiment. FIG. 8C is a side view of the system 800 in an intermediate configuration, and FIG. 8D is a side view of the system 800 in a raised configuration. The system 800 includes a set of bottom components 802, a set of top components 830, a lifting assembly 840, a lock assembly 860, and a release device 890. The system 800 may be used to selectively raise a bed (e.g., the bed 10) disposed on the system 800 off a surface (e.g., a floor such as a hardwood floor, a vinyl floor, a marbled floor, a concrete floor, a tiled floor, a carpeted floor, or any other surface on which the system 800 is disposed) or lower the bed towards the surface. The system 800 is substantially similar to the system 200, but without a securement assembly and including an intermediate configuration.

The plurality of bottom components 802 are configured to be positioned on the surface. The plurality of bottom components 802 may include flat plates formed from a strong and rigid material (e.g., metals such as cast iron or stainless steel). As shown in FIG. 8A, the set of bottom components 802 include a pair of bottom components 802 disposed parallel to each other. In other embodiments, the set of bottom components 802 may include larger number of bottom components 802 (e.g., 3, 4, or even more) for example, may include bottom components disposed between the pair of bottom components 802 shown in FIG. 8A. In some embodiments, a plurality of decorative boards (not shown) may be positioned around the plurality of bottom components 802, for example, to prevent a user from seeing the plurality of bottom components 802 and/or the lifting assembly 840 (e.g., for aesthetic purposes).

A plurality of bottom component feet 804 may be disposed beneath the bottom components 802 and coupled thereto. The plurality of bottom component feet 804 configured to support the set of bottom components 802 on the surface. In some embodiments, at least a contact surface of each of the bottom component feet 804 that contacts the surface on which the system 800 is disposed includes a slip resistant material (e.g., a high friction material such as rubber or may include grooves that increase friction) to prevent slipping of the system 800 over the surface as the lifting assembly 840 is moved between a raised configuration and a lowered configuration, as described herein.

A pair of bottom component cross-members 810 are disposed perpendicular to a longitudinal axis defined by each of the set of bottom components 802 and coupled to the pair of bottom components 802. For example, a first one of the pair of bottom component cross-members 810 is coupled to a first longitudinal end of each of the set of bottom components 802, and a second one of the pair of bottom component cross-members 810 is coupled to a second longitudinal end of each of the set of bottom components 802 opposite the first longitudinal end. In some embodiments, bottom component cross-member mounts 807 may be disposed at each of the first and second longitudinal ends, each of which defines a channel configured to receive an end of a corresponding bottom component cross-member 810. The end of the bottom component cross-member 810 may be secured within the channel via securing members (e.g., pins, screws, nuts, rivets, etc.). In some embodiments, the plurality of bottom component cross-members 810 may have an adjustable length, for example, be telescopic so as to allow adjustment of the length of the plurality of bottom component cross-members 810. In this manner, a spacing between the set of bottom components 802 may be adjusted to accommodate beds having different sizes (e.g., single, twin, full, queen, king, California king, or any other suitable shape or size bed).

Each top component 830 of the set of top components 830 is coupled to corresponding bottom component 802 of the set of bottom components 802, as described herein. As shown in FIG. 8A, the set of top components 830 includes a pair of top components 830 coupled to a corresponding bottom component 802 of the pair of bottom components 802. In some embodiments, each top component 830 includes a top component first portion 831 and a top component second portion 832 coupled to each other via a coupling bracket 834. Each of the top component first portion 831 and the top component second portion 832 may be telescopic, thereby allowing adjustment of a length of each top component 830 for accommodating various size beds. A top component coupling bracket slot 837 may be defined in each of the top component coupling brackets 834 and structured to receive at least a portion of an orthogonal beam, for example, an orthogonal beam included in a support assembly 1000*a* as described with respect to FIG. 10A.

In some embodiments, bed base mounting brackets 836 may be disposed on the longitudinal ends of each of the plurality of top components 830. The bed base mounting brackets 836 are structured to be coupled to a bed base (e.g., a box spring, or slats) to secure the bed base the top components 830. In other embodiments, the system 800 may also include frame mounting brackets 814 configured to couple a bed frame and, in some embodiments, side boards to the set of top components 830.

In some embodiments, the system 800 may also include a one or more top component cross members 812 coupled to opposing top components 830 of the set of top components 830 and positioned orthogonal thereto so as to provide mechanical strength and structural rigidity for receiving the bed thereon. For example, top component cross-member mounting members 813 may be disposed on each top component 830 and define a channel for receiving a respective longitudinal end of the one or more top component cross-members 812. The one or more top component cross-members 812 may be coupled to the corresponding top component cross-member mounting member 813 via a friction fit, a snap fit, or using a coupling member (e.g., pins, screws, bolts, rivets, etc.) Moreover, the one or more top component cross-members 812 may be telescopic or otherwise have an adjustable length to allow adjustment of a spacing between adjacent top components 830, for example, as described with respect to the bottom component cross-members 810.

The lifting assembly 840 is coupled to each of the plurality of bottom components 802 and the plurality of top components 830 and comprises a plurality of lifting members each having a lifting member first end pivotally coupled to at least one bottom component 802 of the plurality of bottom components 802, and a lifting member second end opposite the lifting member first end pivotally coupled to at least one top component 830 of the plurality of top components 830.

The plurality of lifting members include a first set of lifting members 841 including a first portion comprising a pair of first lifting member plates 842 disposed proximate to a corresponding bottom component 802 and pivotally coupled to the corresponding bottom component 802 at first lifting member plate first ends. The first lifting member plates 842 are disposed on either side of the corresponding bottom component 802 such that the bottom component 802 is interposed therebetween. The first set of lifting members 841 also include a second portion comprising a first strut 844 fixedly coupled at a first strut first end to first lifting member plate second ends opposite the first lifting member plate first ends, and having a first strut second end opposite the strut first end pivotally coupled to a corresponding top component 830.

Each of the pair of first lifting member plates 842 also include a first lifting member plate projection 843 extending orthogonally away from a longitudinal axis of the first lifting member plate 842 and in a direction away from the securement assembly 820. The lifting assembly 840 also includes one or more lifting assembly biasing members 846. The biasing members 846 may comprise, for example, a tension spring, a helical spring, an extension spring, a bungee cord, or any other biasing member. A first end of the one or more lifting assembly biasing members 846 is coupled to a corresponding first lifting member plate 842, for example, to the first lifting member plate projection 843, and a second end of the lifting assembly biasing member 846 is coupled to the corresponding bottom component 802.

A tensioning member 847 may be operatively coupled to the second end of each of the lifting assembly biasing member 846 and structured to couple the second end of the lifting assembly biasing member 846 to the corresponding bottom component 802, for example, to a tensioning member mounting bracket 848 coupled to the corresponding bottom component 802. The tensioning member 847 may be configured to adjust the biasing force of the at least one lifting assembly biasing member 846. For example, the tensioning member 847 may include a slidable or otherwise movable coupling.

The tensioning member 847 may be configured to move the coupling location of the second end of the lifting assembly biasing member 846 closer to or further away from the first end of the lifting assembly biasing member 846. This may adjust a tension in the lifting assembly biasing member 846 (e.g., a tension spring) by extending or shortening a length of the lifting assembly biasing member 846, thereby adjusting a biasing force exerted by the lifting assembly biasing member 846 on the first set of the lifting members 841.

The one of more biasing members 846 are configured to apply a tensioning force on the first set of lifting members 841 so as to urge the lifting assembly 840 towards the raised configuration. While FIG. 8A shows two lifting assembly biasing members 846 located on each of the pair of bottom components 802, in other embodiments the lifting assembly 840 may only include a single lifting assembly biasing member 846 per bottom component 802. In this manner, the number of lifting assembly biasing members 846 can be increased or decreased, and/or a tension in each of the lifting assembly biasing member 846 may be adjusted to control an amount of tension exerted on the first set of lifting members 841 so as to allow lifting of a bed having a weight in a range of 60 lbs to 600 lbs.

The plurality of lifting members also include a second set of lifting members 851 including a first portion comprising a pair of second lifting member plates 852 disposed proximate to a corresponding bottom component 802, and pivotally coupled to the corresponding bottom component 802 at second lifting member plate first ends. The second lifting member plates 852 are disposed on either side of the corresponding bottom component 802 such that the bottom component 802 is interposed therebetween. The second set of lifting members 841 also include a second portion comprising a second strut 854 fixedly coupled at a second strut first end to second lifting member plate second ends opposite the second lifting member plate first ends, and having a second strut second end opposite the second strut first end pivotally coupled to a corresponding top component 830.

The lifting assembly 840 also includes a damper 856 (e.g., a hydraulic shock absorber, a twin tube shock absorber, a mono tube shock absorber, a pneumatic shock absorber, or any other suitable damper). A damper first end of the damper 856 is coupled to one of the second lifting member plates 852, and a damper second end of the damper 856 opposite the damper first end is coupled to the corresponding bottom component 802 proximate to the second end of the corresponding lifting assembly biasing member 846, for example, via damper mounting bracket 858. The damper 856 is configured to damp motion of the lifting assembly 840 as it moves from the raised configuration to the lowered configuration. The dampening effect of the damper may reduce the effective weight of the bed 10 to less than 20 lbs, thereby reducing a chance of injury if the lifting assembly 840 is accidentally moved from the raised to the lowered configuration.

As previously described, the lifting assembly 840 is movable between the raised configuration shown in FIG. 8A and the lowered configuration shown in FIG. 8B. In the lowered configuration, the first strut second end and the second strut second end are positioned proximate to the corresponding bottom components 802 such that the plurality of top components 830, and thereby the bed positioned thereon, is positioned proximate to the surface (e.g., the floor) on which the plurality of bottom components 802 are positioned. The top component coupling bracket 834 may include a slot 835 that is configured to, for example, receive a portion of a limit pin 838 so as to limit motion of the lifting assembly 840 as it moves from the raised configuration to the lowered configuration or to the intermediate configuration.

The lifting assembly 840 also includes a locking member 880 coupled to the second set of lifting members 851, for example, to a corresponding second lifting member plate 852. The locking member 880 is configured to move between a locked position to lock the lifting assembly 840 in each of a raised configuration, the intermediate configuration, and a lowered configuration of the lifting assembly 840, and an unlocked position to allow the lifting assembly 840 to be moved between the raised configuration, the intermediate configuration, and the lowered configuration.

The locking member 880 may include a locking member body 881 pivotally mounted on the corresponding second lifting member plate 852 at a central portion 883 of the locking member body 881 such that the locking member body 881 is rotatable about its central portion 883. A first ledge 882 (e.g., a hook) is defined at a locking member body first end. The first ledge 882 is configured to engage an upper post-lock 806 (e.g., a first pin) in the intermediate configuration of the lifting assembly 840 so as to secure the lifting assembly 840 in the intermediate configuration. In some embodiments, an audible sound (e.g., a click) may occur when the first ledge 882 is engaged with the upper post-lock 806. The upper post-lock 806 is mounted on a bumper foot hinge 808 that elevates the upper post-lock 806 such that as the locking member 880 raises with the raising of the lifting assembly 840, the first ledge 882 is able to engage the upper post-lock 806.

A second ledge 884 is defined at a locking member body second end opposite the locking member body first end. The second ledge 884 is configured to engage a lower post-lock 809 provided on the corresponding bottom component 802, in the lowered configuration of the lifting assembly 840 so as to secure the lifting assembly 840 in the lowered configuration. The first ledge 882 extends in a first orthogonal direction away from the locking member body 881, and the second ledge 884 extends in a second orthogonal direction away from the locking member body 881, which is opposite the first orthogonal direction. This allows the locking member 880 to rotate about its central portion 883 to cause the first ledge 882 and the second ledge 884 to either engage or disengage the upper post-lock 806 and the lower post-lock 809, respectively. In some embodiments, a height of the lower post-lock 806 may be adjustable up or down so as to accommodate variances in minimum heights of a bed and/or bed frame disposed on the system 800.

In some embodiments, a third ledge 885 is defined at a locking member body intermediate position in between the locking member body first end and the locking member body second end. The locking member body intermediate position may be or may not be equidistant between the locking member body first end and the locking member second end. The third ledge 885 may be configured to engage the upper post-lock 806 in the intermediate configuration of the lifting assembly 840 so as to secure the lifting assembly 840 in the intermediate configuration.

In some embodiments, the locking member 880 further comprises a locking biasing member 846 coupled to the locking member 880 and configured to urge the locking member 880 into the locked position in each of the raised configuration, intermediate configuration, and the lowered configuration of the lifting assembly 840. For example, a first end of the locking biasing member 846 is coupled to the corresponding bottom component 802 and a second end of the locking biasing member 846 is coupled to a portion of the locking member body 881 proximate to the first ledge 882 and offset from the central portion 883. This causes the tension force exerted by the locking biasing member 846 on the locking member 880 to rotate about its central portion 883 towards the locked position in each of the raised, intermediate, and lowered configurations of the lifting assembly 840.

The lock assembly 860 is operatively coupled to the lifting assembly 840. For example, the lock assembly 860 may be coupled to a longitudinal end of the system 800, for example, to the pair of top components 830. As shown in FIG. 8A, a pair of lock assembly coupling arms 871 are coupled to a corresponding top components 830 and extend longitudinally away therefrom. A lock assembly coupling cross-bar 873 is positioned perpendicular to the pair of lock assembly coupling arms 871 and coupled at its longitudinal ends thereto, for example, via coupling members. The lock assembly 860 is coupled to the lock assembly cross-bar 873 via a lock assembly mounting bracket 870.

As previously described, the lifting assembly 840 is movable between the raised configuration shown in FIG. 8A and the intermediate configuration shown in FIG. 8C. In the intermediate configuration, the first strut second end and the second strut second end are positioned in an intermediate position in between proximate to the bottom components 802 and distal to the bottom components 802. The bed positioned thereon is raised or lifted upwards off of the surface in which the plurality of bottom components 802 are positioned. The lifting assembly biasing members 846 bias the lifting assembly 840 towards the intermediate configuration facilitating lifting of the lifting assembly 840 towards the intermediate configuration. Moreover, the damper 856 dampens downwards motion of the lifting assembly 840 towards the lowered configuration, thereby preventing accidental dropping of the bed from the intermediate to the lowered configuration that can cause injury. In the intermediate configuration, the first strut 844 and the second strut 854 form an intermediate angle with the bottom components 802. The intermediate angle is in a range of about 5 and about 85 degrees (5 degrees, 15 degrees, 25 degrees, 35 degrees, 45 degrees, 55 degrees, 65 degrees, 75 degrees, or 85 degrees, inclusive). In such embodiments, the first ledge 882 (e.g., hook) is configured to engage the upper post-lock 806 (e.g., the first pin) in the intermediate configuration in order to position the bed at the intermediate angle.

FIG. 8D shows a side view of the raised configuration shown in FIG. 8A. In the raised configuration, the first strut second end and the second strut second end are positioned distal to the plurality of bottom components 802 so that the plurality of top components 830, and thereby the bed positioned thereon, are raised or lifted upwards off the surface on which the plurality of bottom components 802 are positioned. The lifting assembly biasing members 846 bias the lifting assembly 840 towards the raised configuration facilitating lifting of the lifting assembly 840 towards the raised configuration. Moreover, the damper 856 dampens downwards motion of the lifting assembly 840 towards the lowered configuration, thereby preventing accidental dropping of the bed from the raised to the lowered configuration that can cause injury. In the raised configuration, the first strut 844 and the second strut 854 form a raised angle with the bottom components 802. The raised angle may be about 90 degrees. In such embodiments, the third ledge 885 (e.g., hook) is configured to engage the upper post-lock 806 (e.g., the first pin) in the raised configuration in order to position the bed at the raised angle.

The system 800 may have the lock assembly 860 (shown in FIG. 8A) substantially similar to the lock assembly 260 as described in FIGS. 3A-B. The lock assembly 860 includes a lock assembly housing (e.g., similar to the lock assembly housing 261) which may include a housing base (e.g., similar to the housing base 626). The housing base may be shaped so as to define a cavity (e.g., similar to the cavity 263) for receiving a distal end of the release device 890. The lock assembly 860 includes a lock/unlock member (e.g., similar to the lock/unlock member 266) and a set of cables 876 (e.g., similar to the set of cables 276) coupling the lock/unlock member to the locking member 880.

The system 800 may further include the release device 890 substantially similar to the release device 290 as described in FIGS. 3A-B and configured to be selectively engaged with the lock/unlock member by a user. The release device 890 may include a release device arm 892 (e.g., similar to the release device 292), a release device magnet (e.g., similar to the release device magnet 298), and a handle 894 (e.g. similar to the handle 294). The distal end of the release device 890 is configured to be inserted into the cavity. In some embodiments, a lock/unlock member magnet (e.g., similar to the lock/unlock member magnet 268) is disposed on an end of the lock/unlock member so as to increase the attractive force between the distal end of the release device arm 892 and the lock/unlock member. The release arm 892 may include a bend (similar to the bend 296)

such that the distal end of the release arm 892 forms a hook. The release device 890 may be removable.

Figure 9:
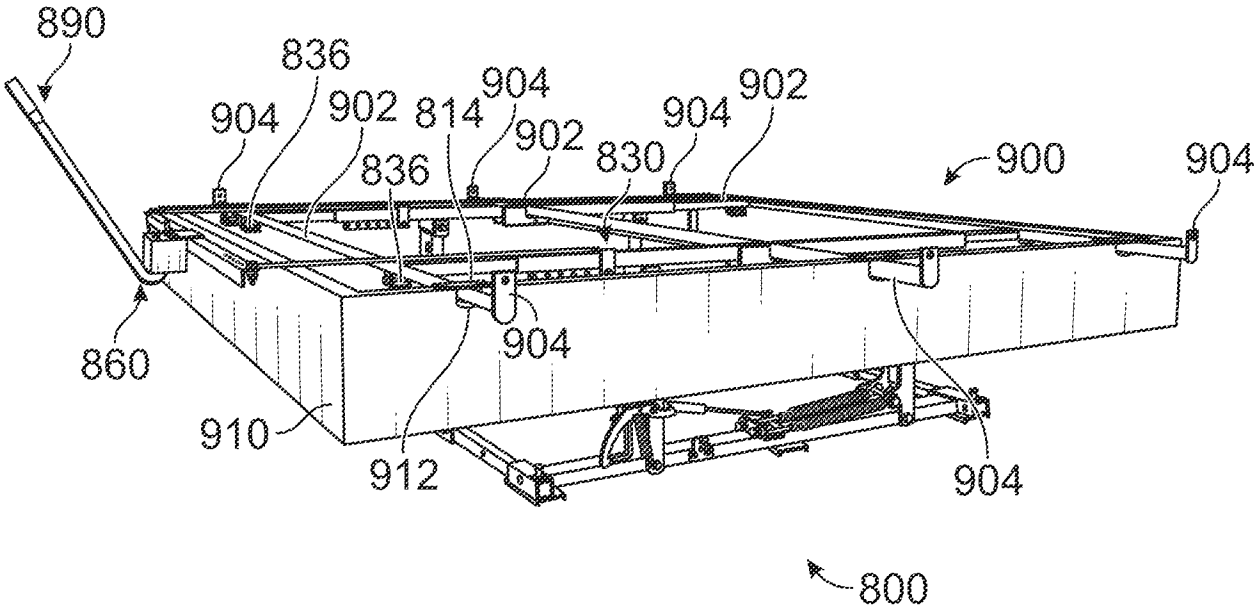
FIG. 9 is top, front, right perspective view of the lift system of FIGS. 8A-8D with a hospitality style bed base coupled thereto, according to an embodiment.

Various attachments can be coupled to the system 800 or any other system described herein to accommodate various beds or configurations of beds. For example, FIG. 9 is a perspective view of the system 800 showing a hospitality style bed base 900 (hereinafter "bed base 900") coupled to the system 800. The bed base 900 may include set of orthogonal beams 902 oriented perpendicular to a longitudinal axis of the system 800 and coupled to the longitudinal ends of each of the top components 830 via the bed base mounting brackets 836. First flanges 904 extend from an axial end of the orthogonal beams 902 and configured to house a bed (e.g., a box spring or a mattress) therebetween. The bed base 900 may be coupled to the top components 830, for example, via the bed base mounting brackets 836. The bed base 900 may also include a bed frame 910 coupled to the orthogonal beams 902 and/or the top components 830 via the bed frame mounting brackets 814. Slots 912 may be defined in the bed frame 910 within which corresponding portions of the orthogonal beams 902 may be disposed such that the bed may be disposed on the bed frame 910.

Figure 10A:
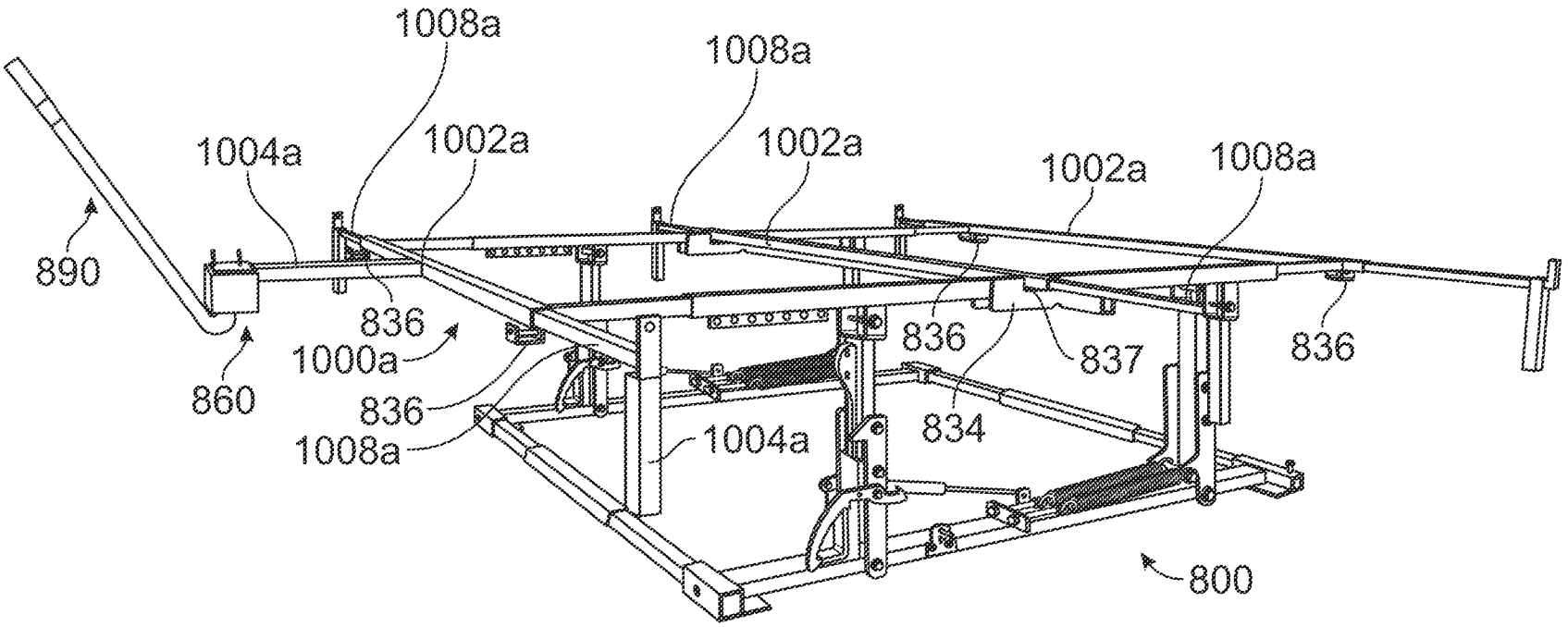
FIG. 10A is a top, front, right perspective view of the lift system of FIGS. 8A-8D with a plurality of orthogonal bars coupled thereto for directly attaching to a box spring or a platform, according to another embodiment.

FIG. 10A is a perspective view of a support assembly 1000*a* coupled to the system 800, which is structured to mount a box spring or a platform. The support assembly 1000*a* includes a plurality of orthogonal beams 1002*a* oriented perpendicular to the top components 830 and coupled thereto. For example, an orthogonal beam 1002*a* may be coupled to each longitudinal end of the top components 830 via the bed base mounting brackets 836, and one orthogonal beam 1002*a* may be disposed across through each of the top component coupling bracket slots 837. Each of the orthogonal beams 1002*a* include legs 1004*a* extending perpendicular to the orthogonal beams 1002*a* from a location proximate to axial ends of the orthogonal beams 1002*a* towards a surface on which the system 800 is disposed. The legs 1004*a* are structured to support the bed in the lowered configuration of the lifting assembly 800. Each of the orthogonal beams 1002*a* include extensions 1008*a* extending beyond the lifting assembly 800. The extensions 1008*a* are configured to adjust a spacing of the support assembly 1000*a*, for example, to accommodate a box spring or platform having various widths. A box spring can be directly coupled to the orthogonal beams via coupling members (e.g., screws, bolts, nuts, rivets, etc.) or any other suitable coupling mechanism.

Figure 10B:
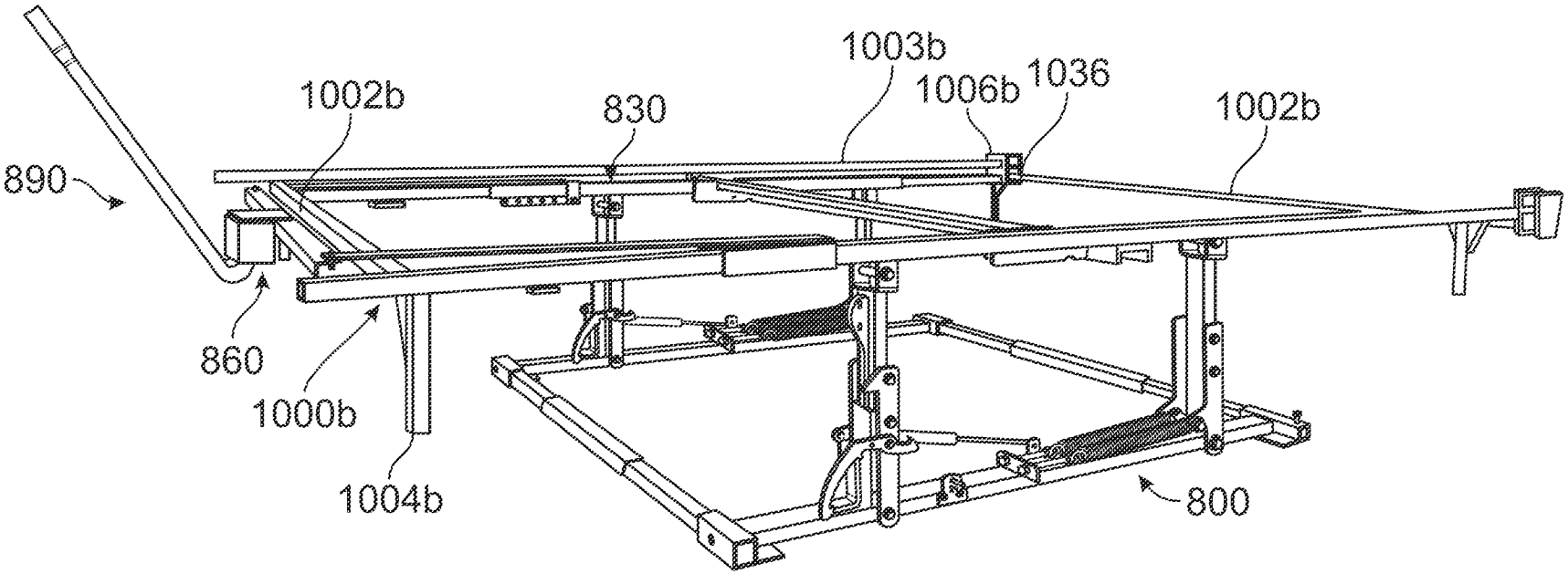
FIG. 10B is a top, front, right perspective view of the lift system of FIGS. 8A-8D having a bed frame coupled thereto, according to an embodiment.

FIG. 10B is a perspective view of a bed frame 1000*b* coupled to the system 800. The bed frame 1000*b* includes a set of orthogonal beams 1002*b* coupled to longitudinal ends of the top components 830 via the bed base mounting brackets 836 and oriented perpendicular to the top components 830. A set of longitudinal beams 1003*b* are coupled to axial ends of the orthogonal beams 1002*b* and configured to support a bed (e.g. a box spring and/or a mattress thereon). Bed frame brackets 1006*b* are disposed at corners of the bed frame located at a longitudinal end of the bed frame 1000*b* opposite the lock assembly 860, and are configured to prevent slipping of the bed (e.g., a box spring or a mattress) off the bed frame 1000*b*. Moreover, each of the orthogonal beams 1002*b* include legs 1004*b* extending perpendicular to the orthogonal beams 1002*b* from a location proximate to axial ends of the orthogonal beams 1002*b* towards a surface on which the system 800 is disposed. The legs 1004*b* are structured to support the bed in the lowered configuration of the lifting assembly 800.

Figure 11:
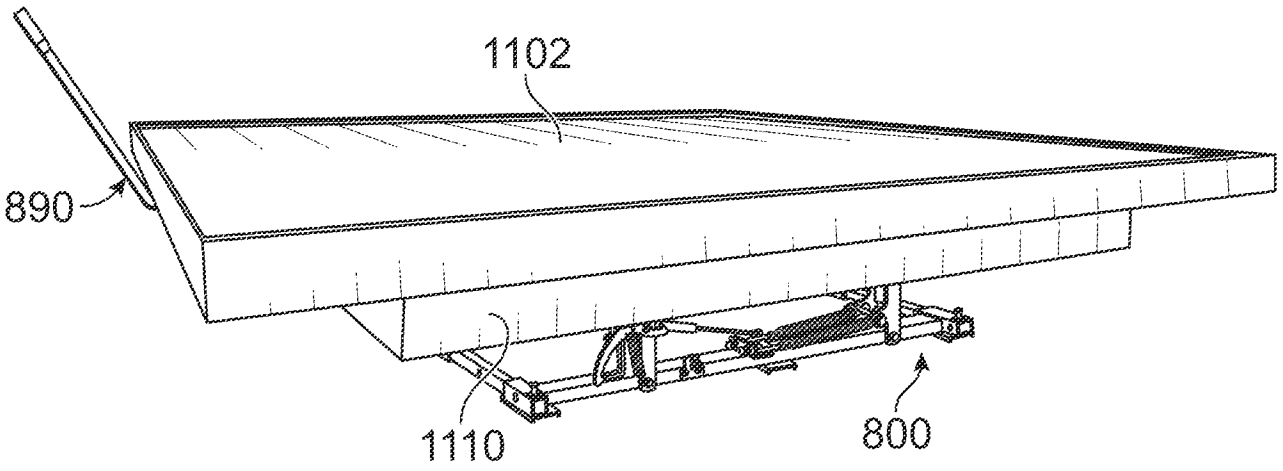
FIG. 11 is a top, front, right perspective view of the lift system of FIGS. 8A-8D with a bed platform disposed thereon, according to another embodiment.

FIG. 11 shows a perspective view of the system 800 according to another arrangement in which a platform 1102 is disposed on the system 800, for example, on the set of top components 830, and is configured to receive a bed thereon, such that a box spring is not used (e.g., in a low platform bed configuration). Side boards 1110 may also be disposed around the set of top components 830, and the platform 1102 disposed thereon.

It should be noted that the term "example" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Additionally, it should be understood that features from one embodiment disclosed herein may be combined with features of other embodiments disclosed herein as one of ordinary skill in the art would understand. Other substitutions, modifications, changes and omissions may also be made in the design, operating conditions and arrangement of the various exemplary embodiments without departing from the scope of the present invention.

While this specification contains many specific implementation details, these should not be construed as limitations on the scope of any inventions or of what may be claimed, but rather as descriptions of features specific to particular implementations of particular inventions. Certain features described in this specification in the context of separate implementations can also be implemented in combination in a single implementation. Conversely, various features described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

What is claimed is:

1. A lift system, comprising:

a plurality of bottom components positionable on a surface;

a plurality of top components structured to support a structure;

a lifting assembly coupled to each of the plurality of bottom components and the plurality of top components, the lifting assembly comprising:

a plurality of lifting members, each of the plurality of lifting members having a lifting member first end coupled to at least one bottom component of the plurality of bottom components, and a lifting member second end opposite the lifting member first end coupled to at least one component of the plurality of top components, and a locking member configured to move between a locked position to lock the lifting assembly in each of a raised configuration and a lowered configuration of the lifting assembly, and an unlocked position to allow the lifting assembly to be moved between the raised configuration and the lowered configuration;

a lock assembly coupled to the lifting assembly, the lock assembly comprising:

a lock/unlock member, and at least one linking component coupling the lock/unlock member to the locking member; and a release device selectively engageable with the lock/unlock member so as to cause the lock/unlock member to move, the movement of the lock/unlock member pulling the linking component and causing the locking member to move into the unlocked position so as to allow the user to move the lifting assembly between the lowered configuration and the raised configuration.

2. The lift system of claim 1, wherein the release device has a distal end, the distal end being engageable with an end of the lock/unlock member that is proximate to the distal end of the release device.

3. The lift system of claim 1, wherein the lock/unlock member comprises a fixed end that is pivotally mounted such that the end that is proximate to the release device is a movable end.

4. The lift system of claim 1, wherein the lock assembly comprises an external structure that is engageable by the release device.

5. The lift system of claim 4, wherein the external structure defines a cavity configured to receive at least a portion of the release device.

6. The lift system of claim 1, wherein the release device is engageable with a portion of the structure so as to allow the user to pull the lock assembly, and thereby the lifting assembly, from the lowered configuration into the raised configuration.

7. The lift system of claim 1, wherein the locking member comprises:

a locking member body mounted on the corresponding lifting member at a central portion of the locking member body such that the locking member body is movable;

a first ledge defined at a locking member body first end, the first ledge configured to engage a upper post-lock in the raised configuration of the lifting assembly so as to secure the lifting assembly in the raised configuration; and a second ledge defined at a locking member body second end opposite the locking member body first end, the second ledge configured to engage a lower post-lock in the lowered configuration of the lifting assembly so as to secure the lifting assembly in the lowered configuration.

8. The lift system of claim 7, further comprising:

a locking biasing member coupled to the locking member and configured to urge the locking member into the locked position in each of the raised configuration and the lowered configuration of the lifting assembly.

9. The lift system of claim 1, wherein the locking member is further configured to lock the lifting assembly in an intermediate configuration, the intermediate configuration being between the raised configuration and the lowered configuration, wherein the unlocked position is further configured to allow the lifting assembly to be moved between the raised configuration and the intermediate configuration or between the intermediate configuration and the lowered configuration, and wherein the locking member is moved into the unlocked position by the release device so as to allow the user to move the lifting assembly between the lowered configuration and the intermediate configuration or the intermediate position and the raised configuration.

10. The lift system of claim 9, wherein the locking member comprises:

a locking member body mounted on the corresponding lifting member at a central portion of the locking member body such that the locking member body is movable;

a first ledge defined at a locking member body first end, the first ledge configured to engage an upper post-lock in the intermediate configuration of the lifting assembly so as to secure the lifting assembly in the intermediate configuration;

a second ledge defined at a locking member body second end opposite the locking member body first end, the second ledge configured to engage a lower post-lock in the lowered configuration of the lifting assembly so as to secure the lifting assembly in the lowered configuration; and a third ledge defined at a locking member body intermediate position in between the locking member body first end and the locking member body second end, the third ledge configured to engage the upper post-lock in the raised configuration of the lifting assembly so as to secure the lifting assembly in the raised configuration.

11. A lift system, comprising:

a plurality of bottom components positionable on a surface;

a plurality of top components structured to support a structure;

a lifting assembly coupled to each of the plurality of bottom components and the plurality of top components, the lifting assembly comprising a plurality of lifting members, each of the plurality of lifting members having a lifting member first end coupled to at least one bottom component of the plurality of bottom components, and a lifting member second end opposite the lifting member first end coupled to at least one component of the plurality of top components; and a release device selectively engageable with the lifting assembly for moving the lifting assembly between a raised configuration and a lowered configuration.

12. The lift system of claim 11, wherein the release device is further selectively engageable with the lifting assembly for moving the lifting assembly to an intermediate configuration between the raised configuration and the lowered configuration.

13. The lift system of claim 12, further comprising:

a locking member configured to move between (i) a locked position to selectively lock the lifting assembly in each of the raised configuration, the intermediate configuration, and the lowered configuration of the locking assembly, and (ii) an unlocked position so as to allow the lifting assembly to be moved between the raised configuration, the intermediate configuration, and the lowered configuration.

14. The lift system of claim 13, further comprising:

a lock assembly coupled to the lifting assembly, the lock comprising:

a lock/unlock member, and at least one linking component coupling the lock/unlock member to the locking member.

15. The lift system of claim 14, wherein the release device comprises a release device magnet and the lock assembly comprises a lock/unlock magnet, wherein the release device magnet and the lock/unlock magnet are configured to selectively engage the release device and the lock assembly.

16. The lift system of claim 13, wherein the locking member comprises:

a locking member body mounted on the corresponding lifting member at a central portion of the locking member body such that the locking member body is movable;

a first ledge defined at a locking member body first end, the first ledge configured to engage a upper post-lock in the intermediate configuration of the lifting assembly so as to secure the lifting assembly in the intermediate configuration;

a second ledge defined at a locking member body second end opposite the locking member body first end, the second ledge configured to engage a lower post-lock in the lowered configuration of the lifting assembly so as to secure the lifting assembly in the lowered configuration; and a third ledge defined at a locking member body intermediate position in between the locking member body first end and the locking member body second end, the third ledge configured to engage the upper post-lock in the raised configuration of the lifting assembly so as to secure the lifting assembly in the raised configuration.

17. A lift system, comprising:

a plurality of bottom components positionable on a surface;

a plurality of top components structured to support a structure;

a lifting assembly coupled to each of the plurality of bottom components and the plurality of top components, the lifting assembly comprising:

a plurality of lifting members, each of the plurality of lifting members having a lifting member first end coupled to at least one bottom component of the plurality of bottom components and a lifting member second end opposite the lifting member first end coupled to at least one component of the plurality of top components, and a locking member configured to move between a locked position to selectively lock the lifting assembly in each of a raised configuration, an intermediate position, and a lowered configuration, of the lifting assembly, and an unlocked position to allow the lifting assembly to be moved between the raised configuration, the intermediate configuration, and the lowered configuration;

a release device selectively engageable with the lifting assembly for moving the lifting assembly between the raised configuration, the intermediate configuration, and the lowered configuration.

18. The lift system of claim 17, further comprising a lock assembly coupled to the lifting assembly, the lock comprising:

a lock/unlock member, and at least one linking component coupling the lock/unlock member to the locking member.

19. The lift system of claim 17, further comprising:

a locking member body mounted on the corresponding lifting member at a central portion of the locking member body such that the locking member body is movable;

a first ledge defined at a locking member body first end, the first ledge configured to engage a upper post-lock in the intermediate configuration of the lifting assembly so as to secure the lifting assembly in the intermediate configuration;

a second ledge defined at a locking member body second end opposite the locking member body first end, the second ledge configured to engage a lower post-lock in the lowered configuration of the lifting assembly so as to secure the lifting assembly in the lowered configuration; and a third ledge defined at a locking member body intermediate position in between the locking member body first end and the locking member body second end, the third ledge configured to engage the upper post-lock in the raised configuration of the lifting assembly so as to secure the lifting assembly in the intermediate configuration.

20. The lift system of claim 18, wherein the release device comprises a release device magnet and the lock assembly comprises a lock/unlock magnet, the release device magnet and the lock/unlock magnet configured to selectively engage the release device and the lock assembly.

* * * * *